US011044953B1

(12) United States Patent
Towne

(10) Patent No.: US 11,044,953 B1
(45) **Date of Patent: *Jun. 29, 2021**

(54) DISPOSABLE SLEEVE MEMBER TO ABSORB MOISTURE FROM COUGHING OR SNEEZING AND METHOD OF USING THE SAME

(71) Applicant: James C. Towne, Redmond, WA (US)

(72) Inventor: James C. Towne, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/099,227

(22) Filed: Nov. 16, 2020

Related U.S. Application Data

(63) Continuation of application No. 16/840,192, filed on Apr. 3, 2020, now Pat. No. 10,863,778.

(51) Int. Cl.
*A41D 20/00* (2006.01)
*A41D 27/12* (2006.01)
*A41B 15/00* (2006.01)

(52) U.S. Cl.
CPC ..... *A41B 15/00* (2013.01); *A41D 20/00* (2013.01); *A41D 27/12* (2013.01)

(58) Field of Classification Search
CPC ..... A01N 59/00; A01N 25/34; A41D 27/12; A41D 20/00; A41D 19/0024; A41D 19/0082; A41D 1/04; A41D 2300/332; A41D 2400/52; A41D 27/13; A41D 31/02; A41D 31/125; A41D 31/30; A41D 13/1138; A41D 19/002; A41D 19/0037; A41D 19/01594; A41D 2400/72; A41D 31/185; B32B 2555/00; B32B 7/12; B32B 2307/726; B32B 2535/00; B32B 2571/00; B32B 2307/51; B32B 2307/7145; A45F 5/04; A45F 2005/008; Y10T 24/1368; A61F 5/0118; A41B 15/00
See application file for complete search history.

(56) References Cited

U.S. PATENT DOCUMENTS 4,244,057 A * 1/1981 Burnham ..... A41D 19/0024 2/160
4,401,233 A * 8/1983 Frey ..... A45D 44/00 221/185
4,536,889 A * 8/1985 Taylor ..... A44C 5/0046 2/160

(Continued)

FOREIGN PATENT DOCUMENTS

WO 22007/053816 A2 5/2007

*Primary Examiner* — Robert H Muromoto, Jr.
(74) *Attorney, Agent, or Firm* — Seed IP Law Group

(57) ABSTRACT

A simple wearable member having germ absorbing layers that include germicide particles is provided. The germicide particles in the germ absorbing layer can capture the germs expelled into the air when a user coughs or sneezes into the wearable member. Once the germs are captured in the germ absorbing layer, the germs are neutralized by the germicide particles. In order to enhance the probability of capturing most of the germs expelled, the germ absorbing layer includes various fibers with shapes and patterns. The flexible fibers are treated to have germicide particles in them. The various shapes, sizes, and patterns of the flexible fibers create a large surface area that the germs can contact when they are expelled into the air. Once the germ absorbing layer is used the layer may be discarded and a new layer may be attached to the wearable member for repeated use.

20 Claims, 13 Drawing Sheets

(56) References Cited

U.S. PATENT DOCUMENTS 4,805,242 A * 2/1989 Bolton ..... A41D 19/002 2/160
5,678,728 A * 10/1997 Leto ..... B65D 83/0805 221/185
5,901,379 A * 5/1999 Hirata ..... A61F 5/0118 2/170
6,074,525 A * 6/2000 Richards ..... D21F 11/006 162/100
D446,381 S * 8/2001 Garfield ..... D2/500
6,403,216 B1 6/2002 Doi et al.
7,690,050 B2 * 4/2010 Stockhamer ..... A41D 1/04 2/16
7,766,014 B2 * 8/2010 Piret ..... A61F 13/12 128/204.13
7,862,877 B2 * 1/2011 Balzano ..... A61L 2/232 428/76
D645,246 S * 9/2011 Miller ..... D3/247
8,091,552 B2 * 1/2012 Stockhamer ..... A61F 13/126 128/206.19
8,910,312 B1 * 12/2014 Apisa ..... A41D 27/12 2/170
8,938,812 B1 * 1/2015 Gandy ..... A41D 27/13 2/55
9,491,977 B2 * 11/2016 Marovets ..... A41D 19/0082
9,615,573 B1 * 4/2017 Moore ..... A01N 65/26
10,051,902 B2 * 8/2018 Del Valle ..... A41D 20/00
10,314,354 B2 * 6/2019 Mata ..... A41D 31/125
10,863,778 B1 * 12/2020 Towne ..... A41B 15/00 2/1
2002/0073475 A1 * 6/2002 Bloom ..... A41D 27/12 2/69
2002/0084279 A1 * 7/2002 Lickstein ..... A47K 10/42 221/24
2004/0031120 A1 * 2/2004 Cherian ..... A41D 19/0024 15/227
2004/0161450 A1 * 8/2004 Buder ..... A01N 31/14 424/443
2005/0129897 A1 * 6/2005 Zhou ..... B32B 7/12 428/43
2009/0145445 A1 * 6/2009 Quinn ..... A01N 25/34 128/863
2011/0088132 A1 * 4/2011 McNamee-Sollars ..... A41D 27/12 2/46
2011/0314581 A1 * 12/2011 Gaters ..... A41D 27/12 2/16
2012/0066816 A1 * 3/2012 Starr ..... A41D 27/12 2/243.1
2014/0325738 A1 * 11/2014 Marovets ..... A41D 19/0024 2/159

* cited by examiner

DISPOSABLE SLEEVE MEMBER TO ABSORB MOISTURE FROM COUGHING OR SNEEZING AND METHOD OF USING THE SAME

CROSS-REFERENCE TO RELATED APPLICATIONS

This application is a continuation of U.S. patent application Ser. No. 16/840,192, filed Apr. 3, 2020, which is hereby incorporated by reference in its entirety.

BACKGROUND

Technical Field

The present disclosure relates to capturing, holding and controlling (until disposal or killing) germs discharged into the environment primarily by human coughing or sneezing. More particularly, it relates to a germ absorbing and containing fabric (either natural or synthetic) incorporated into a device that can be attached to or worn on the hand, wrist or arm, the purpose of reducing the spread of germs.

Description of the Related Art

Many of the products in the market, such as masks or tissues, are used for covering up or cleaning up germs, viruses, and bacteria created from coughing or sneezing. An average cough or sneeze can discharge about 100,000 contagious germs into the air at speeds up to about 100 miles per hour. While facial masks may be able to cover the germs from an unhealthy individual, the masks may be full of germs and inappropriate to use for longer than a certain duration of time. Similarly, tissues may be used to clean up the germs from an unhealthy individual who coughed or sneezed, but these tissues may still contain germs. When germs in these masks or tissues are not properly eradicated with germicide and thrown away properly, the masks and tissues may be a secondary source for additional contamination to the general public.

Relatedly, for those unhealthy individuals that do not carry masks or tissues with them or if they are not in a situation to use one when the coughing or sneezing happens, as an etiquette, the individual may cough into or sneeze into their clothes, into the crook of the elbow, into their hands, or into their forearm. However, even so, the germs discharged from the cough or the sneeze are likely to be there for a significant amount of time, as no effort was made to eradicate these germs using a germicide. For example, the discharged substance during coughing or sneezing is likely to remain on the clothes or the skin (if the individual coughed or sneezed into his/her bare skin instead of the clothes) and may risk those who come in contact with that individual's clothes or skin. By coughing or sneezing again into the same place, an individual would further increase the possibility of spreading the germs.

BRIEF SUMMARY

The present disclosure provides a germ absorbing member having therein a germ absorbing layer including germicides. In one or more embodiments, the germ absorbing member may implemented as a wearable cloth. The germ absorbing layer is configured to capture the aerosol droplets containing germs discharged from coughs and sneezes. The term germs as used herein includes any and all types of microbes, bacteria, viruses, or any biological organism that can cause harm to a person. The germ absorbing layer according to the present disclosure is configured to capture these aerosol droplets that travel at a high speed.

In one or more embodiments, the germ absorbing layer includes germicide materials or germicide layers to eradicate and neutralize the captured aerosol droplets containing germs discharged by coughs and sneezes. The germicide included in the wearable cloth may remove or kill the germs and effectively deter the spread of germs.

In one or more embodiments, once the germ absorbing layer is used, the layer may be detached from the wearable cloth and a new germ absorbing layer may be attached to the same corresponding location of the wearable cloth.

Accordingly, in a situation where a cough or sneeze occurs without warning or with little warning (for example, a person may not have sufficient time to reach into his or her bag or pocket for a facial mask, a handkerchief, or a tissue), the wearable cloth having a germ absorbing layer provides an individual with a timely and risk-free solution that prevents the spread of germs. That is, with the wearable cloth strapped around the arm, even the cough or sneeze comes without notice, the individual may quickly and timely cough or sneeze into the wearable cloth. Further, it will be a risk-free solution as the germs discharged from the nose and mouth will be caught by the germ absorbing layer and will be eradicated or neutralized through the germicide included in the germ absorbing layer.

To protect the general public health, there is an increasing need that germs from a cough or sneeze be effectively captured to control their spread. Society is entering a new phase in which there is an increasing vigilance to protect against the spread of any type of germs from one person to another and the present disclosure provides that protection. Particularly during times of low or modest contagion, masks are not generally worn in social circumstances such as around the home, office, work floor of a factory, or other public place. Every-day living, for everyone, may now require a better means to capture coughs and sneezes without masks, just about all the time. An easy-to-use, physically comfortable, inexpensive, socially unobtrusive means of capturing discharged germ-containing moisture droplets and holding such droplets for proper sanitary disposal protocol is provided herein.

BRIEF DESCRIPTION OF THE SEVERAL VIEWS OF THE DRAWINGS

Reference will now be made by way of example to the accompanying drawings. In the drawings, identical reference numbers identify similar elements or acts. In some drawings, however, different reference numbers may be used to indicate the same or similar elements. The shapes of various elements and angles are not necessarily drawn to scale, and some of these elements may be enlarged and positioned to improve drawing legibility.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or methods associated with germ absorbents, germicides, and attachment structures have not been shown or described in detail to avoid unnecessarily obscuring descriptions of the embodiments.

Unless the context indicates otherwise, throughout the specification and claims which follow, the word "comprise" and variations thereof, such as, "comprises" and "comprising" are to be construed in an open, inclusive sense that is as "including, but not limited to." Further, the terms "first," "second," and similar indicators of the sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

Figure 1:
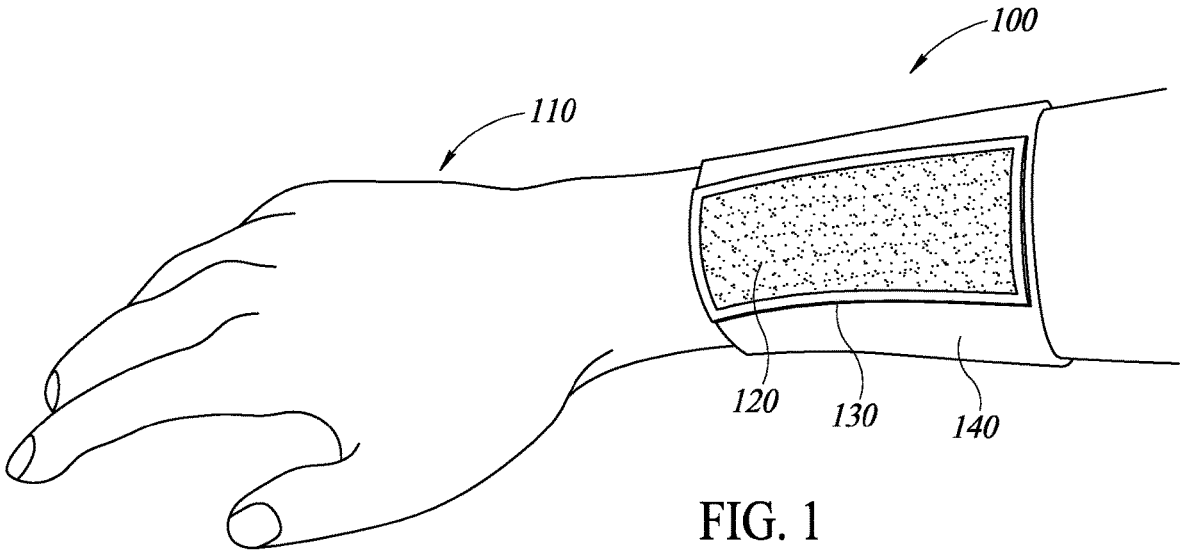
FIG. 1 illustrates a germ absorbing member according to one or more embodiments of the present disclosure.

FIG. 1 illustrates a germ absorbing member 100 according to one or more embodiments of the present disclosure. The germ absorbing member 100 includes a germ absorbing layer 120, a moisture absorbing barrier 130, and an attachment member 140. In one or more embodiments, the germ absorbing layer 120 may be implemented as one or more pads/sheets into which a user can cough or sneeze. The moisture absorbing barrier 130 is positioned below the germ absorbing layer 120 so that the moisture from the cough or sneeze does not permeate into the cloth or skin of the user (e.g., waterproof). The attachment member 140 is coupled to the moisture absorbing barrier 130 and is configured to be attached to the user's arm 110. The attachment member 140 may be attached anywhere between the wrist and the arm pit. The term "arm" as used herein includes the entire arm appendage from the fingers to the shoulder. It thus includes the palm, back of the hand, wrist, forearm, elbow, upper arm, armpit, shoulder and all other portions of the arm, as well as the front, back and side regions of each of these portions. The attachment member 140 is configured to be slidably movable along various locations upon the arm 110 so that a user can comfortably cough or sneeze into the germ absorbing member 100. The attachment member 140 may be washable and reusable. In a preferred embodiment, the attachment member includes moisture barrier that prevents any moisture thereon from reaching the arm or clothing of the user.

The germ absorbing layer 120 may be a disposable pad that can be peeled off after use. For example, when the germ absorbing member 100 is worn on the user's arm, the user can cough or sneeze into the germ absorbing layer 120 while the germ absorbing member 100 is attached to the arm and after a single use or a predetermined number of uses, the germ absorbing layer 120 can be peeled off and discarded. The germ absorbing layer 120 may be a biodegradable material.

The term germ as used herein is used to comprehensively include any byproducts such as microorganisms, microbes, mucous, bacteria (e.g., *Streptococcus pneumonia, Haemophilus* influenza, tuberculosis, pneumonia, etc.), viruses, mucus, irritants, bacillus, bugs, saliva, respiratory pathogens, substances causing influenza (e.g., respiratory syncytial virus (RSV), adenoviruses, etc.) and other infectious substances expelled from coughing or sneezing. Generally, these germs may burst out from the user in the form of microscopic aerosol droplets.

The germ absorbing layer 120 is incorporated into an article (i.e., germ absorbing member 100) which is worn on an arm of a user for catching and eradicating germs from the user's orifices (e.g., mouth or nose). The germ absorbing member 100 may be attached to the arm of the user in a semi-permanent manner. The user can cough or sneeze into the germ absorbing layer 120 by putting the user's orifices against the germ absorbing layer 120 to catch germs. The germ absorbing layer 120 may be implemented using a spongy absorbing material, fabric, fiber, or the like. The term "fiber" as used herein includes structure that is made having filaments or threads, whether synthetic or natural. Synthetic fibers include rayon, nylon, polyester, polyurethane, polyether, polyurethane-urea, resin, acrylic, polyolefin, and other man made materials. A polyurethane, polyether, or polyurethane-urea fiber that incorporates a water absorbing resin will normally be preferred to a nylon or polyolefin that are more likely to repel water. Natural fibers include wool, silk, cotton, linen, tree derivatives (bark, paper, etc.) hemp, flax, and many more. The natural fiber will be selected for its moisture adhering and absorbing properties, so it is much likely to use a cotton or tree fiber derivative rather than a wool or a linen.

The germ absorbing layer 120 may be elastic so that the user can seal his or her mouth or nose around it.

FIG. 1 shows the attachment member 140 being implemented as an elastic arm band. The attachment member 140 may have the moisture absorbing barrier 130 and the germ absorbing layer 120 which are implemented as a rectangular pad that can be peeled off, and discarded after use.

The moisture absorbing barrier 130 and the germ absorbing layer 120 which are implemented as a pad (or a sheet) may have an adhesive layer at the back of each pad. This adhesive layer is exposed whenever either the germ absorbing layer 120 or the moisture absorbing barrier 130 is peeled off. This allows the moisture absorbing barrier 130 to stick to the bare skin or the cloth (e.g., sleeve) of a user. In some embodiments, the germ absorbing member 100 may not require the attachment member 140 when the moisture absorbing barrier 130 has an adhesive backing. This embodiment will be explained in detail later on. The germ absorbing layer 120 or the moisture absorbing barrier 130 may adhere to the user with the help of the adhesive backing and may be entirely disposable after a single use or a predetermined number of uses.

The moisture absorbing barrier 130 is constructed having a layer of moisture impermeable material so that the germs from the germ absorbing layer 120 do not penetrate into the skin or cloth of the user. In some embodiments, impermeable fibers, non-plastic impermeable materials, a thin plastic layer, a sealing material and any other suitable materials can be used as one layer in the moisture absorbing barrier 130 and the disclosure is not limited to these examples.

Figure 2A:
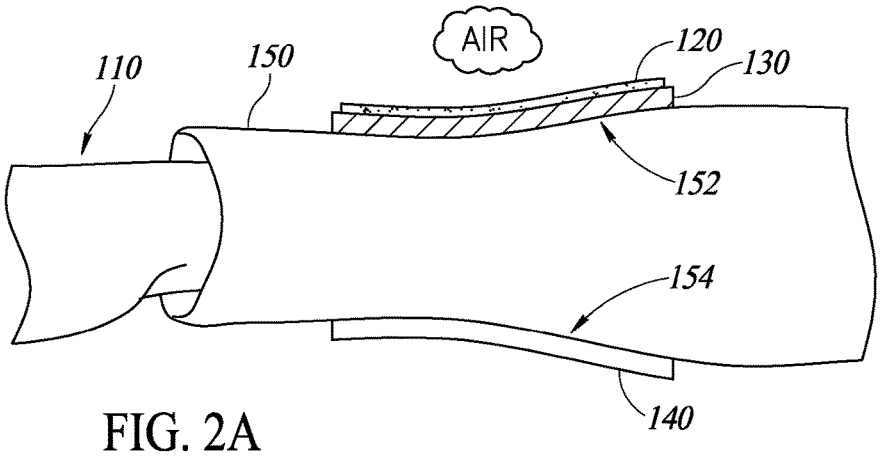
FIG. 2A illustrates a cross-sectional view of the germ absorbing member of FIG. 1 while coupled to the arm of a user.

FIG. 2A illustrates a cross-sectional view of a germ absorbing member 100 according to one or more embodiments of the present disclosure. As shown, the germ absorbing member 100 is strapped around an arm 110 of a user. In FIG. 2A, the germ absorbing member 100 is strapped around the wrist of the user. However, the material used for the germ absorbing member 100 is a stretchable, pliable, or flexible material and the germ absorbing member 100 may be affixed to any part of the user's arm 110. Based on the location where each individual user feels comfortable in coughing or sneezing into, the germ absorbing member 100 may be positioned around the wrist, the elbow, the forearm, or near the arm pit of the user. In this embodiment, a moisture absorbing barrier 130 is directly contacting a clothing 150 of the user. That is, in a side 152 of the clothing 150 that is facing the face of the user, the moisture absorbing barrier 130 directly contacts the clothing 150 of the user. On the other hand, in a side 154 of the clothing 150 that is opposite of the side 152 that is facing the face of the user, an attachment member 140 directly contacts the clothing 150 of the user. Here, the attachment member 140 may be arranged coplanar to the moisture absorbing barrier 130.

The moisture absorbing barrier 130 may have a first adhesive layer arranged on a first side of the moisture absorbing barrier 130. The first side of the moisture absorbing barrier 130 faces side 152 of the clothing 150. A second side of the moisture absorbing barrier 130, which is opposite of the first side, directly contacts the germ absorbing layer 120. A second adhesive layer may be arranged between the germ absorbing layer 120 and the moisture absorbing barrier 130. The second adhesive layer allows the germ absorbing layer 120 to easily attach and detach so that the germ absorbing layer 120 may be disposed of after use. A new germ absorbing layer 120 may be attached onto the second adhesive layer so that the user can cough or sneeze again into the germ absorbing member 100. For example, the rectangular pad-like germ absorbing layer 120 may be peeled off by pulling one end of the germ absorbing layer 120 and may be reattached to the germ absorbing member 100.

The first and second adhesive layers may have properties so that they firmly but gently adhere to the skin or cloth of a user but do not have stickiness.

In one or more embodiments, the germ absorbing layer 120 is adjacent to the ambient air. For example, the germ absorbing layer 120 abuts the ambient air. A top surface of the germ absorbing layer 120 is in direct contact with the ambient air, and the user coughs or sneezes into the germ absorbing layer 120.

Figure 2B:
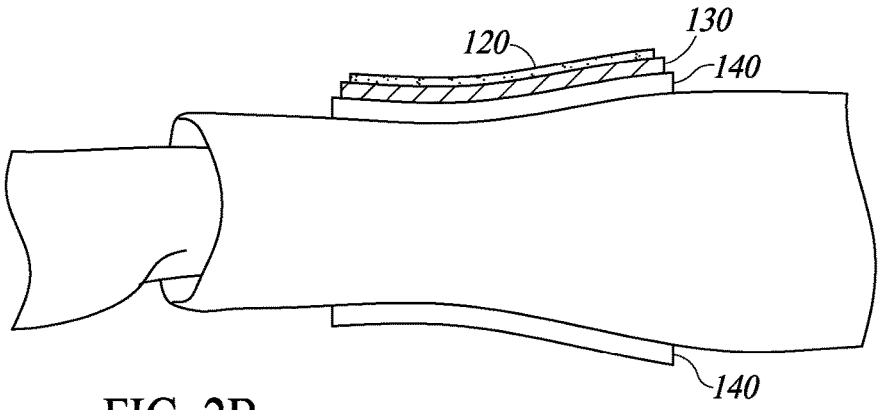
FIG. 2B illustrates a cross-sectional view of a germ absorbing member while coupled to the arm of a user according to other embodiments of the present disclosure.

FIG. 2B illustrates a cross-sectional view of a germ absorbing member 100 according to other embodiments of the present disclosure. In these embodiments, the moisture absorbing barrier 130 may be positioned on the attachment member 140. Here, both the moisture absorbing barrier 130 and the attachment member 140 may function to provide a dual barrier layer for germs. For example, even if some of the germs penetrate through the moisture absorbing barrier 130 or flow over to the sides of the moisture absorbing barrier 130, the material of the attachment member 140 will further protect the clothing 150 or the skin of the user (in cases where the user has attached the germ absorbing member 100 directly onto the skin) from the germs, or the moistures including the germs, from directly contacting the user.

Figure 3:
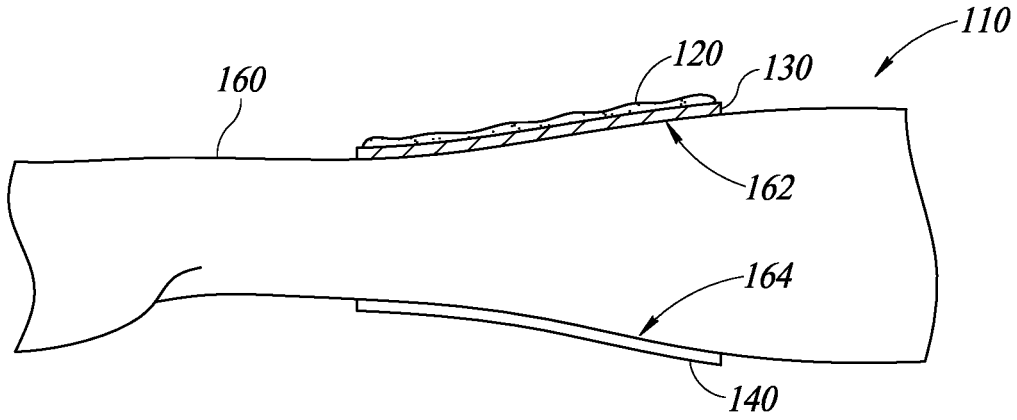
FIG. 3 illustrates a cross-sectional view of a germ absorbing member while coupled to the arm of a user according to yet other embodiments of the present disclosure.

FIG. 3 illustrates a cross-sectional view of a germ absorbing member 100 according to yet other embodiments of the present disclosure. As shown, the germ absorbing member 100 is strapped around an arm 110 of a user without having any cloth in between the skin 160 of the user and the germ absorbing member 100. In this embodiment, a moisture absorbing barrier 130 is directly contacting the skin 160 of the user. That is, in a side 162 of the skin 160 that is facing the face of the user, the moisture absorbing barrier 130 may directly contact the skin 160 of the user. On the other hand, in a side 164 of the skin 160 that is opposite of the side 162 that is facing the face of the user, an attachment member 140 directly contacts the skin 160 of the user. Here, the attachment member 140 may be arranged coplanar to the moisture absorbing barrier 130. However, in other embodiments, the moisture absorbing barrier 130 may be on the attachment member 140 to provide the user with a dual moisture absorbing barrier.

The germ absorbing member 100 according to the present disclosure may have a first adhesive layer arranged between the moisture absorbing barrier 130 and the skin or cloth of the user and a second adhesive layer arranged between the germ absorbing layer 120 and the moisture absorbing barrier 130. In some embodiments, the first and second adhesive layers may use the same type of adhesives. In other embodiments, the first adhesive layer may have stronger adhesive properties than the second adhesive layer so that the germ absorbing member 100 is securely fixated to the arm 110 of the user. In some embodiments, where the first adhesive layer provides firm attachment, the attachment member 140 may be omitted. For example, the germ absorbing member 100 may include the germ absorbing layer 120, the moisture absorbing barrier 130, the first adhesive layer, and the second adhesive layer. Here, the user will not need the attachment member 140 to strap the germ absorbing member 100 to the arm of the user.

The germ absorbing layer 120 as shown in FIG. 3 has a different surface area compared to those shown in connection with FIGS. 2A and 2B. That is, FIGS. 2A and 2B depict a planar, pad-like sheet. However, to increase the surface area of the germ absorbing layer 120, the germ absorbing layer 120 may have various different shapes, patterns, and textures so that it effectively catches the droplets of moisture discharged from a user's orifices. The droplets of moisture or aerosol droplets contain germs, viruses, and bacteria discharged from the coughs and sneezes. As explained previously, the average cough or sneeze can discharge about 100,000 contagious germs into the air at speeds up to about 100 miles per hour. To effectively capture these aerosol droplets that travel at a high speed, the germ absorbing layer 120 according to the present disclosure is configured to have a germ absorbing layer 120 that has a large surface area. Various different shapes, patterns, and textures may be contemplated to provide a large surface area to capture the aerosol droplets. Further embodiments related to the shapes, patterns, and textures of the germ absorbing layer will be detailed in connection with FIGS. 16A-16D.

Referring to FIG. 3, FIG. 3 illustrates a rough or undulating surface pattern. With this surface pattern, the germ absorbing layer 120 may have a higher chance of capturing the aerosol droplets discharged from the user compared to the planar germ absorbing layer 120 shown in connection with FIGS. 2A and 2B, as the surface area has increased.

Figure 4:
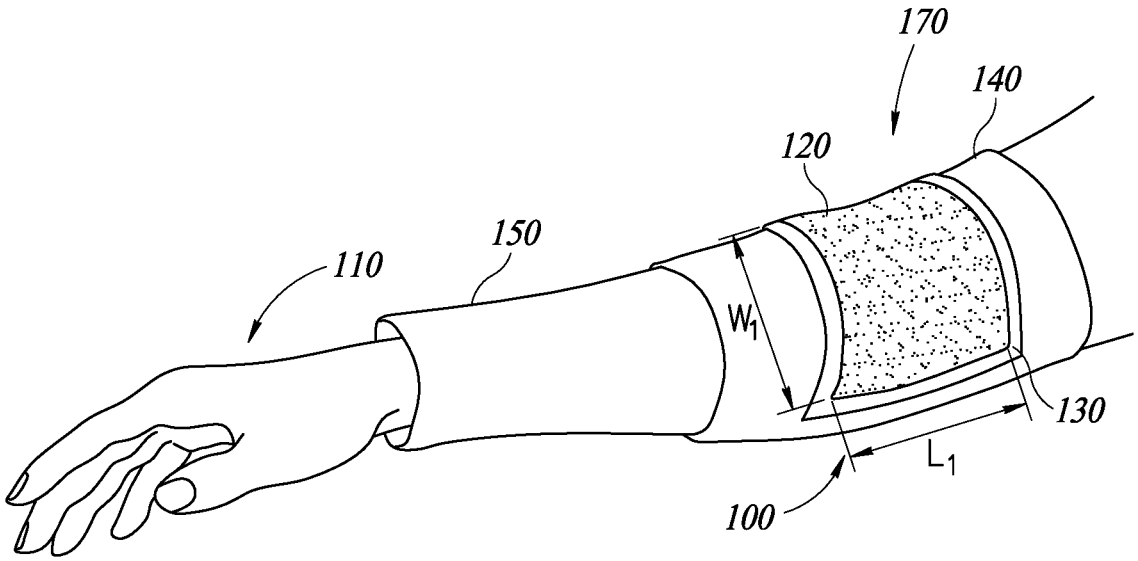
FIG. 4 shows a perspective view of a germ absorbing member positioned on an elbow of a user according to one or more embodiments of the present disclosure.

FIG. 4 shows a perspective view of a germ absorbing member 100 positioned on an elbow of a user according to one or more embodiments of the present disclosure. FIG. 4 shows a germ absorbing layer 120 having a large area. That is, the germ absorbing layer 120 may be implemented as a sheet or a pad having a length $L_1$ and a width Wi. With the germ absorbing layer 120 having a larger area, it helps to mitigate the spread of the various byproducts (e.g., microorganisms, microbes, mucous, bacteria, viruses, mucus, irritants, *bacillus*, bugs, saliva, and other infectious substances) resulting from coughing or sneezing. Further, users that have bigger orifices (e.g., mouth, nose, etc.) may use the germ absorbing layer 120 having a larger area to completely cover their faces when coughing or sneezing. Moreover, a significant reduction of the contamination of the peripheral and surrounding area may be possible with the germ absorbing layer 120 having a larger area as the germ absorbing layer 120 may have a wider catch of the byproducts associated with the user's cough or sneeze.

Even though the germ absorbing member 100 is positioned around the elbow 170 of the user, the attachment member 140 may be implemented as an elastic arm band. Accordingly, the user may slidably move the germ absorbing member 100 to any location upon the arm (e.g., any location from the wrist to the shoulder of the user).

Figure 5:
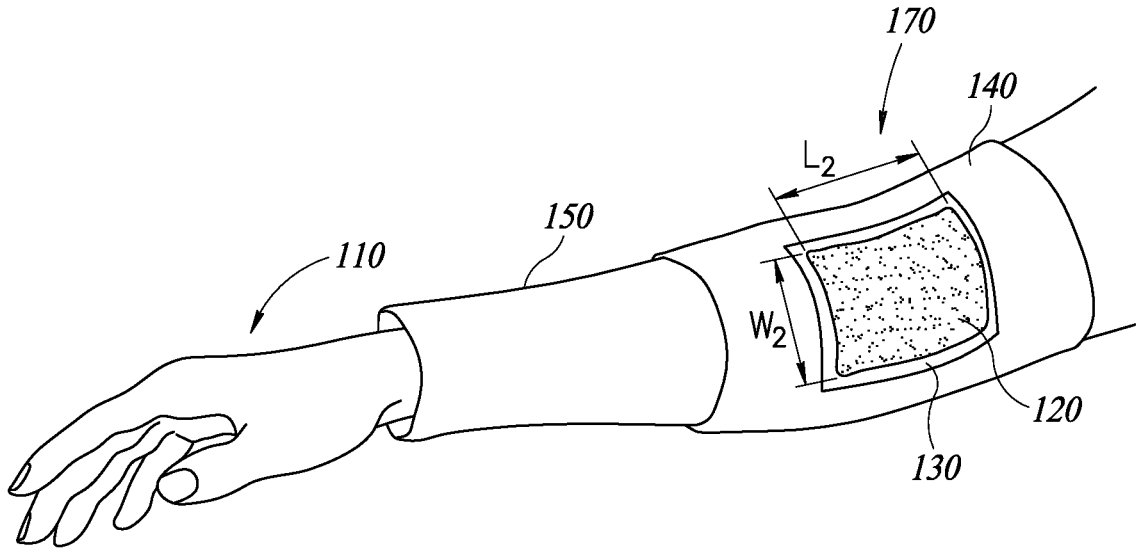
FIG. 5 shows a perspective view of a germ absorbing member positioned on an elbow of a user according to another embodiment of the present disclosure.

FIG. 5 shows a perspective view of a germ absorbing member 100 positioned on an elbow of a user according to another embodiment of the present disclosure. FIG. 5 shows a germ absorbing layer 120 having a relatively smaller area compared to that shown in connection with FIG. 4. That is, the germ absorbing layer 120 may be implemented as a sheet or a pad having a length $L_2$ and a width $W_2$ where length $L_2$ is smaller than length Li and width $W_2$ is smaller than width Wi. A germ absorbing layer 120 having a relatively smaller area may be used by a user that has smaller orifices (e.g., mouth, nose, etc.). For example, for a small child, the germ absorbing layer 120 having a smaller area may be enough to completely cover the face of the child when the child coughs or sneezes. Various sizes and shapes of the germ absorbing member 100 may be contemplated. In some embodiments, the moisture absorbing barrier 130 may substantially have the same size as the germ absorbing layer 120. In some cases, the attachment member 140 may either have substantially the same size as the germ absorbing layer 120 and the moisture absorbing barrier 130. In other cases, as mentioned previously, the attachment member 140 may be completely omitted and the moisture absorbing barrier 130 may be attached directly to the skin or the clothing 150 of the user with the help of adhesive materials on the backside of the moisture absorbing barrier 130 (i.e., the side that contacts the skin or the clothing 150 of the user).

Figure 6A:
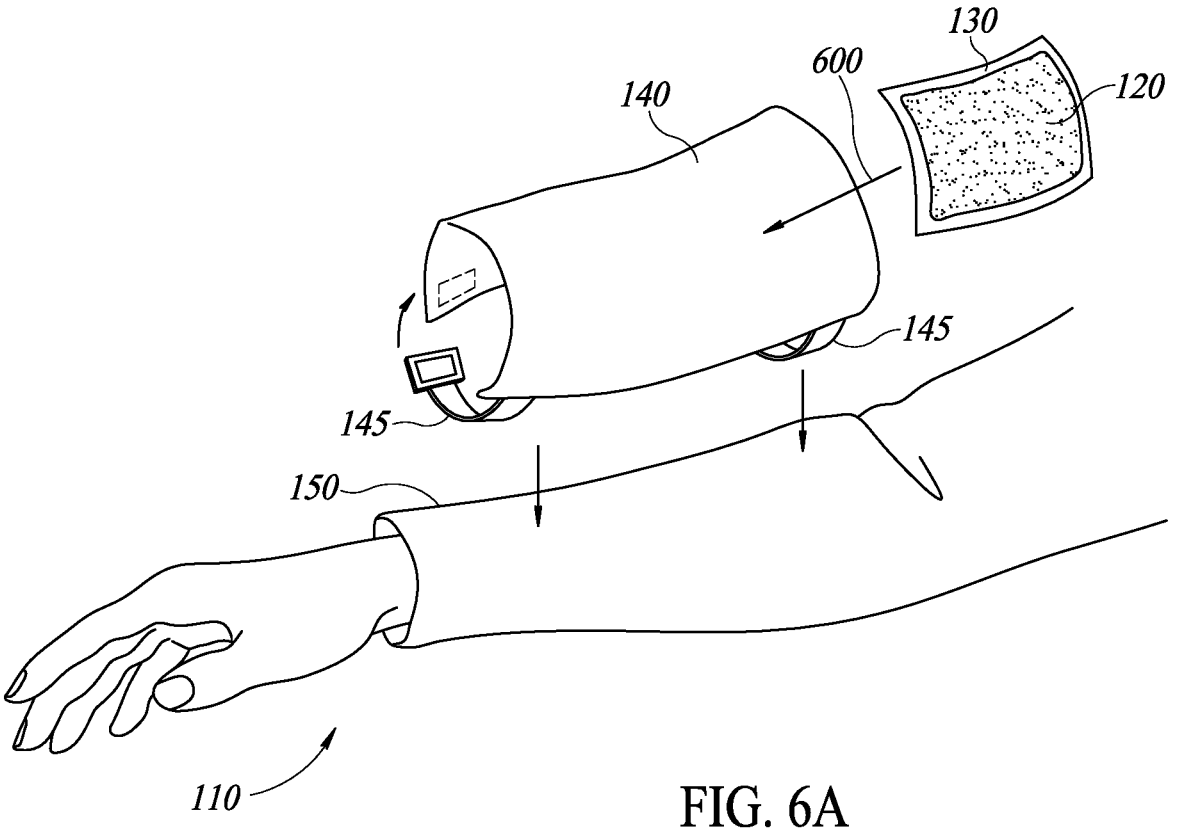
FIG. 6A shows a perspective view of a germ absorbing member positioned on an arm of a user according to one or more embodiments of the present disclosure.

FIG. 6A shows a perspective view of a germ absorbing member 100 positioned on an arm of a user according to one or more embodiments of the present disclosure. In these embodiments, an attachment member 140 is shown to have attachment straps 145A and 145B. In some of the previous embodiments explained, the attachment member 140 was implemented as a stretchable band or an elastic band that can slidably move around any location of the arm. However, in these embodiments, one or more attachment straps 145A and 145B may be used to fixate the germ absorbing member 100 to the user's arm. In one or more embodiments, the attachment straps 145A and 145B may be any suitable fasteners such as a hook-and-loop fastener, adhesives, or a Velcro strap, Velcro tab, band, ties, or any types of adhesive strip. Other various attaching means may be utilized as known in the art.

FIG. 6A shows the attachment member 140 being strapped onto a location between the wrist and the elbow of the user. However, as explained previously, the attachment member 140 may be strapped around any location upon the user's arm using the attachment straps 145A and 145B. For example, it can be connect to the arm between the elbow and the shoulder, very near the shoulder or even wrapping around part of the shoulder and the upper most part of the arm. FIG. 6A illustrates two attachment straps 145A and 145B. However, any number of attachment straps may be used to strap around the user's arm.

In one or more embodiments, the moisture absorbing barrier 130 may be coupled to the germ absorbing layer 120 and may be removed or peeled off from the attachment member 140 together. Once a used germ absorbing layer 120/moisture absorbing barrier 130 is peeled off, a new germ absorbing layer 120/moisture absorbing barrier 130 may be attached onto the attachment member 140. The moisture absorbing barrier 130 has an adhesive material or an adhesive layer on the backing of the moisture absorbing barrier 130 and can be attached in the direction as shown by the arrow 600.

Figure 6B:
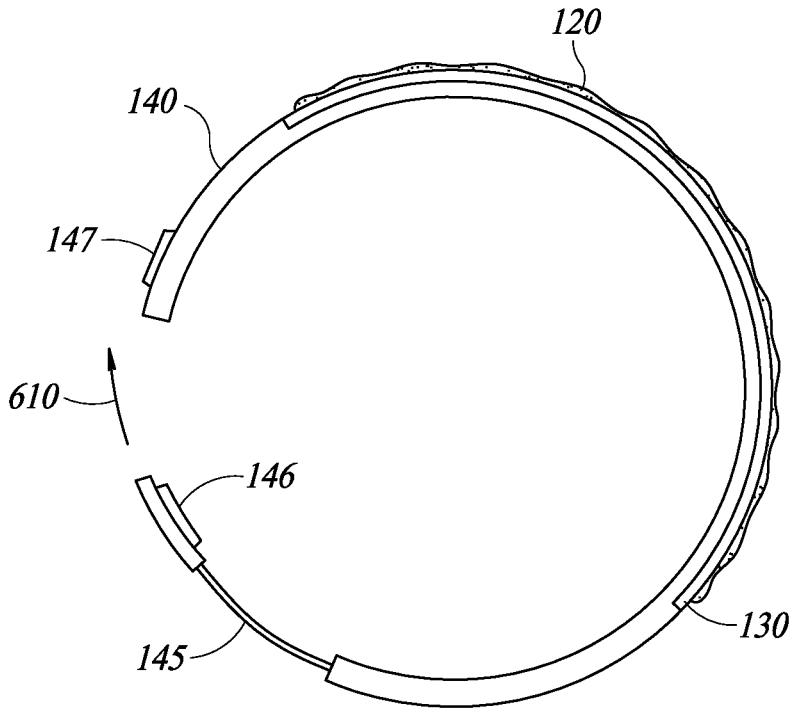
FIG. 6B shows a cross-sectional view of the germ absorbing member of FIG. 6A to be fixed on an arm of a user according to one or more embodiments of the present disclosure.

FIG. 6B shows a cross-sectional view of the germ absorbing member 100 positioned on an arm of a user according to one or more embodiments of the present disclosure. When a user decides where to fixate the germ absorbing member 100 upon the user's arm, the user uses the attachment straps 145 to fasten the germ absorbing member 100 so that it is firmly attached to the desired location upon the arm. A first attachment strap 145A may include a lineal fabric strip with a first sticking portion 146A that could mate with a first receiving sticking portion 147A (for example, another fabric strip) that can be used for attaching temporarily, until pulled apart from each other. For example, the fabric strips may be formed using nylon or polyester. Other suitable materials for temporarily attaching and detaching the first sticking portion 146A to the first receiving sticking portion 147A may be used. A second attachment strap 145B is not shown in FIG. 6B. However, a person of ordinary skill in the art would readily appreciate that the second attachment strap 145B may be implemented similarly to the first attachment strap 145A.

The attachment straps 145 are made with a stretchable material that can extend and contract accordingly to fit the circumference of the user's arm. In some embodiments, the attachment member 140 and the attachment straps 145 may both have stretchable properties to securely strap around the user's arm. In other embodiments, the attachment member 140 may be a relatively less stretchable material compared to the attachment straps 145. In this embodiment, the first attachment strap 145A may have relatively more significant stretchable properties so that it may extend all the way to connect the first sticking portion 146A to the first receiving sticking portion 147A. This will hold the relatively non-stretchable member 140 in place while the stretchable member 145 completes the circle to create the attachment to the arm.

As described, the first attachment straps 145A may be implemented as a stretchable strap or an elastic strap and can be extended toward a direction as shown in the arrow 610 to connect the first sticking portion 146A of the attachment strap 145A to the first receiving sticking portion 147A of the attachment member 140.

As shown in FIG. 6B, the moisture absorbing barrier 130 may be embedded in the attachment member 140. That is, in some embodiments, a top surface of the moisture absorbing barrier 130 and a top surface of the attachment member 140 may be coplanar. In these embodiments, the germ absorbing layer 120 is mounted on top of the moisture absorbing barrier 130. With this configuration, the germ absorbing member 100 may be manufactured at a lesser thickness.

Figure 6C:
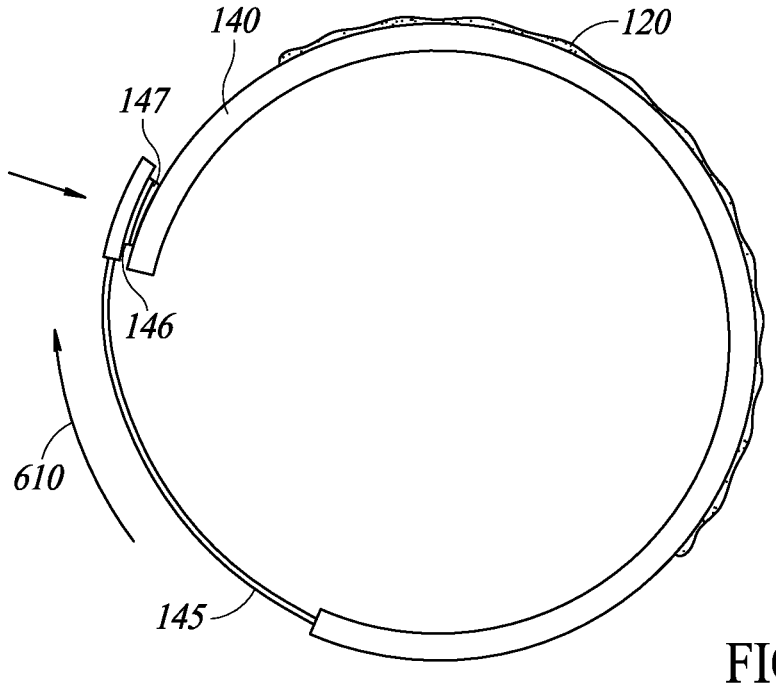
FIG. 6C shows a cross-sectional view of the germ absorbing member of FIG. 6B positioned to be fixed on an arm of a user according to another embodiment of the present disclosure.

FIG. 6C shows a cross-sectional view of a germ absorbing member 100 positioned on an arm of a user according to another embodiment of the present disclosure.

A first attachment strap 145A is extended toward a direction as shown in the arrow 610 and temporarily adheres the first sticking portion 146A of the attachment strap 145A to the first receiving sticking portion 147A of the attachment member 140. The user may detach the first sticking portion 146A from the first receiving sticking portion 147A when the user is not using the germ absorbing member 100. Then the attachment strap 145 may contract to its original size or default state.

As shown in FIG. 6C, the moisture absorbing barrier 130 is omitted. That is, in some embodiments, the attachment member 140 may be formed of impermeable materials capable of blocking the moisture and droplets absorbed from the germ absorbing layer 120 penetrating into the cloth or skin of the user. For example, water resistant materials that are impermeable to bacteria, contaminants, or other byproducts of coughs or sneezes may be used for the attachment member 140. A non-limiting example includes flexible plastic, polyester, PVC, vinyl, any kind of impervious moisture barrier used in the relevant market, or other suitable non-permeable material. In other embodiments, the surfaces of the attachment member 140 may be treated chemically or thermally to acquire non-permeable properties.

When the germ absorbing layer 120 is adhered to the surfaces of the attachment member 140, an adhesive layer may be used to easily stick the germ absorbing layer 120 to the surfaces of the attachment member 140. The adhesive layer may have suitable adhesivity to attach the germ absorbing layer 120 to the attachment member 140 as well as to detach the germ absorbing layer 120 from the attachment member 140.

The germ absorbing layer 120 shown in FIG. 6C has a shape and pattern to increase the surface area of the germ absorbing layer 120. The germ absorbing layer 120 may include germicides or germicide particles. In other embodiments, the germ absorbing layer 120 may be applied with treatment for coating anti-microbial germicidal materials on the surfaces of the germ absorbing layer 120. The germicide can be coating that is obtaining by dipping, inherent in the material being used, (for example colloidal silver, etc.), spray on, chemical, or any other technique of providing a selected type of germicide. Thus the term germicide is used in the broadest sense. This treatment method on the surfaces of the germ absorbing layer 120 may also help eradicate any germs as well as debris and byproducts (e.g., microorganisms, microbes, mucous, bacteria, viruses, mucus, irritants, bacillus, bugs, saliva, and other infectious substances) collected from coughing or sneezing.

In some embodiments, the attachment member 140 may be implemented as a light bracelet spring. The attachment strap 145 may extend in many shapes.

Figure 6D:
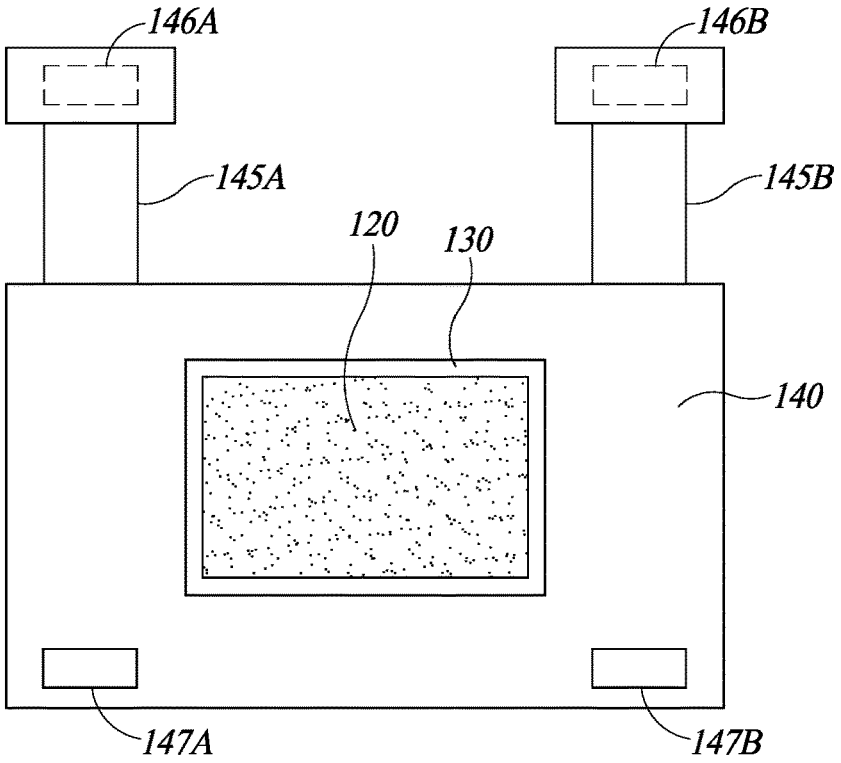
FIG. 6D shows an attachment member according to one embodiment of the present disclosure.

FIG. 6D shows an attachment member 140 according to one embodiment of the present disclosure. A first attachment strap 145A is coupled to one side of the attachment member 140 and a second attachment strap 145B is coupled to another side of the attachment member 140. In other embodiments, more than two attachment straps may be utilized.

At the end of the first attachment strap 145A is a first sticking portion 146A and at the end of the second attachment strap 145B is a second sticking portion 146B. When the user initially attaches the germ absorbing member 100 around the user's arm, the user extends the first attachment strap 145A and adheres the first sticking portion 146A to the first receiving sticking portion 147A. Similarly, the user extends the second attachment strap 145B and adheres the second sticking portion 146B to the second receiving sticking portion 147B. In some embodiments, the elasticity or the stretchability of the first attachment strap 145A and the second attachment strap 145B may differ from each other.

Figure 6E:
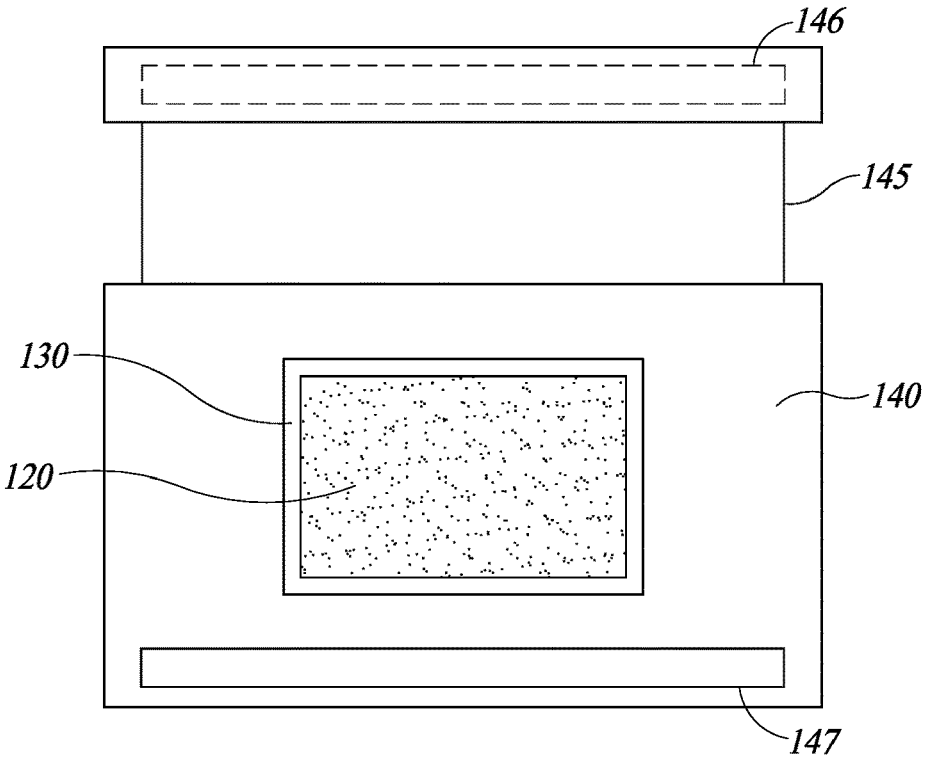
FIG. 6E shows an attachment member according to another embodiment of the present disclosure.

FIG. 6E shows an attachment member 140 according to another embodiment of the present disclosure. Here, the attachment strap 145 may be a single, wide strap. In this embodiment, the attachment strap 145 is between the sticking portion 146 and the attachment member 140. When the user initially attaches the germ absorbing member 100 around the user's arm, the user extends the attachment strap 145 and adheres the sticking portion 146 to the receiving sticking portion 147. Here, the receiving sticking portion 147 has a long rectangular shape to have a corresponding shape to the sticking portion 146 to ensure that the germ absorbing member 100 is appropriately fixated to the arm.

Figure 7:
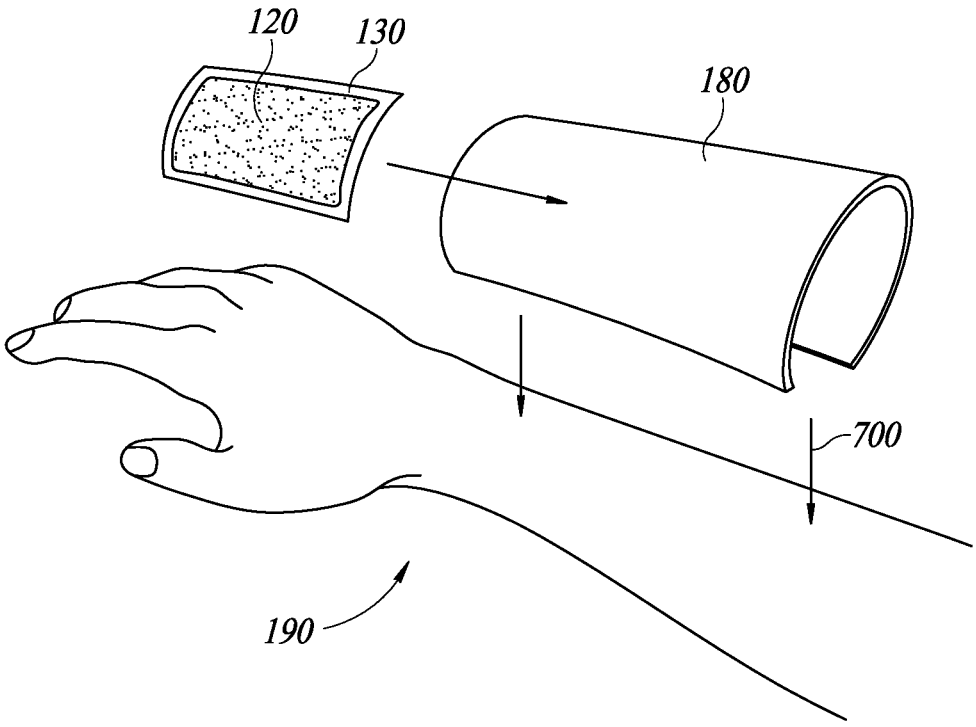
FIG. 7 shows a bracelet having thereon a germ absorbing layer and a moisture absorbing barrier according to one or more embodiments of the present disclosure.

FIG. 7 shows a bracelet 180 having thereon a germ absorbing layer 120 and a moisture absorbing barrier 130 according to one or more embodiments of the present disclosure. The bracelet 180 has an opening on one side of the bracelet 180 so that a user can fit the bracelet 180 onto the user's wrist 190 in the direction of the arrow 700. Once the bracelet 180 is on the user's arm, the user may put the bracelet 180 on his or her wrist 190 or move the bracelet 180 around any location between the elbow and the wrist 190. In some cases, if the diameter of the bracelet 180 is large enough, the bracelet 180 may be positioned closer to the shoulder or the armpit.

In some embodiments, the bracelet 180 may be made of metal or plastic. This metal or plastic may have some pliability or elasticity to widen the opening for the user's wrist 190. The size and dimension of the bracelet 180 may vary depending on the user's personal preference. While the bracelet 180 as shown in FIG. 7 is illustrated having a long length and resembles more of an armor rather than a bracelet, the length of the bracelet 180 may have various sizes and shapes depending on the user's personal preference. That is, in a normal setting the bracelet 180 may also be used as an ornament or as jewelry of the user. In one or more embodiments, the moisture absorbing barrier 130 may have an adhesive backing on the side and the adhesive backing may be used to attach the moisture absorbing barrier 130 to the bracelet 180. Accordingly, when the user is expecting to cough or sneeze, the user can quickly attach a sticky pad or a sticky sheet having the germ absorbing layer 120 and the moisture absorbing barrier 130 to the bracelet 180 and cough or sneeze into it. Alternatively, the user can have the sticky pad or a sticky sheet (or a coating sheet) having thereon the germ absorbing layer 120 and the moisture absorbing barrier 130 on the bracelet 180 and peel it off and discard it after he or she has coughed or sneezed into it. That is, the metal or plastic bracelet may stay in place at the user's arm all day and the sticky sheet or coating sheet may be removed and put back on several times a day.

In one or more embodiments, the moisture absorbing barrier 130 having thereon the germ absorbing layer 120 may be, in itself, a standalone, commercial product. That is, the bracelet 180 does not necessarily have to be a bracelet 180 according to the present disclosure. It may be any kind of bracelet that the moisture absorbing barrier 130 and the germ absorbing layer 120 can adhere to. For example, the product may be implemented as a thin pad or a thin sheet having an adhesive backing. The adhesive backing may be attached with a thin flexible plastic or vinyl so that the user can keep the pad/sheet inside the user's pocket without having the adhesives sticking onto the user's clothing. That is, having a flexible plastic on the back of the moisture absorbing barrier 130 that has been treated with adhesives allows the user to keep the pad/sheet inside the user's pocket without having to worry about the adhesives sticking into the user's clothing. For example, a liner may be used to temporarily cover the adhesive backing.

In one or more embodiments, the moisture absorbing barrier 130 may be coupled to the germ absorbing layer 120 and may be removed or peeled off from the attachment member 140 together. Once a used germ absorbing layer 120/moisture absorbing barrier 130 is peeled off, a new germ absorbing layer 120/moisture absorbing barrier 130 may be attached onto the attachment member 140. The moisture absorbing barrier 130 has an adhesive material or an adhesive layer on the backing of the moisture absorbing barrier 130 and can be attached in the direction as shown by the arrow 700.

In other embodiments, the moisture absorbing barrier 130 and the bracelet 180 may be coupled together and only the germ absorbing layer 120 may be removed or peeled off. Once a used germ absorbing layer 120 is peeled off, a new germ absorbing layer 120 may be attached onto the bracelet 180.

Figure 8:
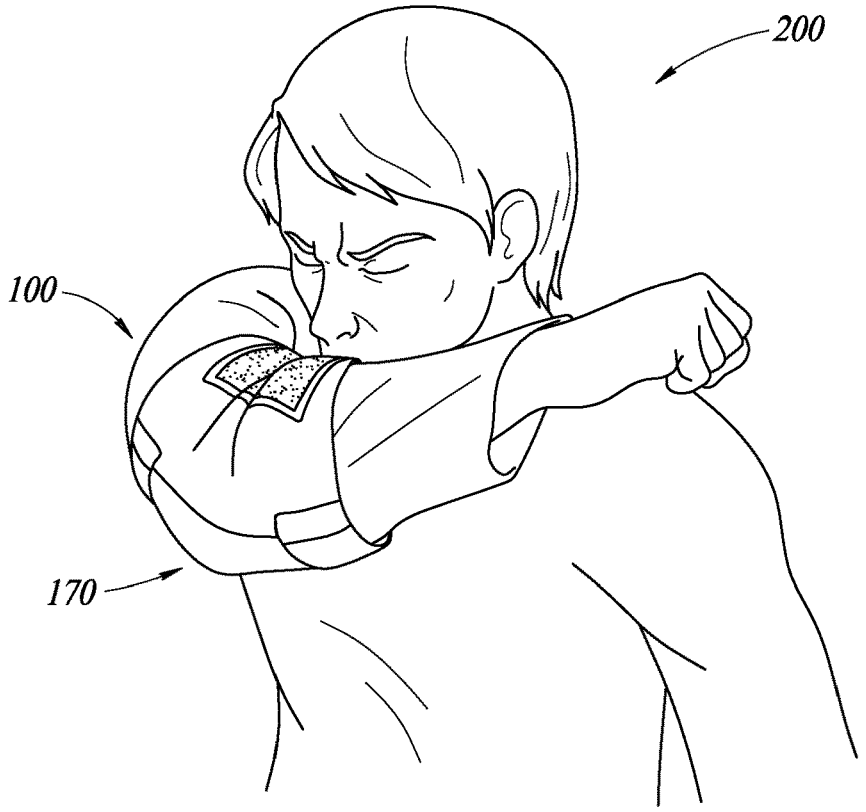
FIG. 8 shows a user having a germ absorbing member strapped around the user's elbow and the user coughing or sneezing into the germ absorbing member.

FIG. 8 shows a user 200 having a germ absorbing member 100 strapped around the user's elbow 170 and coughing or sneezing into the germ absorbing member 100.

In some embodiments, the germ absorbing member 100 may be implemented with a soft, sponge-like fiber material so that the user 200 can comfortably cough or sneeze into the germ absorbing member 100 without experiencing irritation to the user's face. That is, the soft, sponge-like fiber material may also be implemented as a breathable type material.

Although FIG. 8 shows the user 200 coughing or sneezing into elbow 170, the germ absorbing member 100 is made with an extendable and contractible material and is capable of being positioned on any part of the arm.

Figure 9:
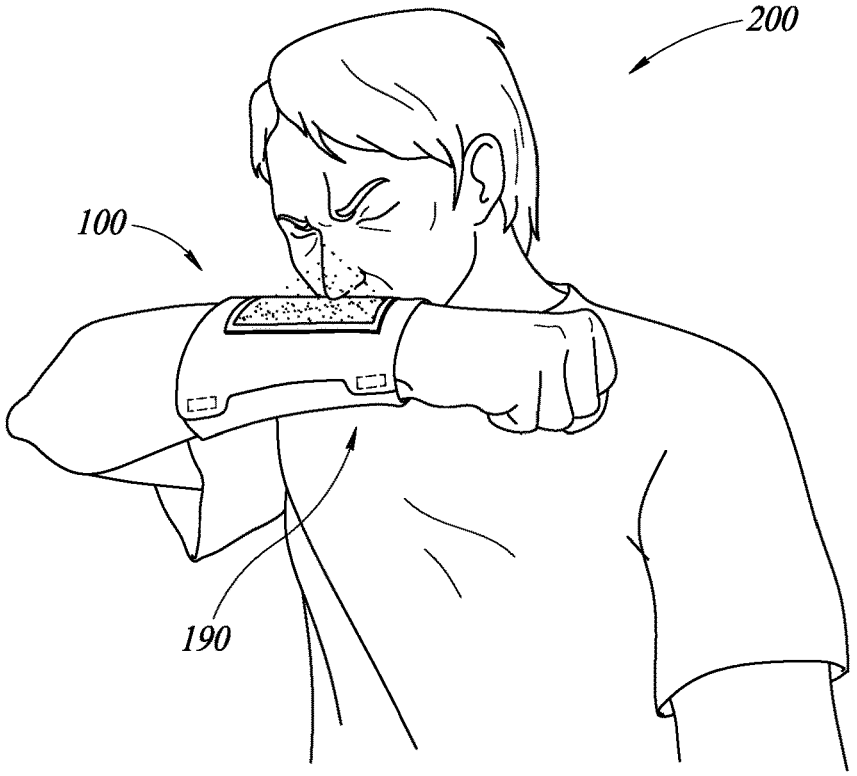
FIG. 9 shows a user having a germ absorbing member strapped around the user's wrist and the user coughing or sneezing into the germ absorbing member.

FIG. 9 shows a user 200 having a germ absorbing member 100 strapped around the user's wrist 190 and coughing or sneezing into the germ absorbing member 100.

In some embodiments, the germ absorbing member 100 may be implemented with an elastic, stretchable arm band that is used around the user's wrist 190. The top surface of the germ absorbing member 100 (i.e., the germ absorbing layer 120) may be made with a soft, sponge-like fiber material so that the user 200 can comfortably cough or sneeze into the germ absorbing member 100 without experiencing irritation to the user's face.

Although FIG. 9 shows the user 200 coughing or sneezing into wrist 190, the germ absorbing member 100 is made with an extendable and contractible material and is capable of being positioned in any part of the arm.

Figure 10:
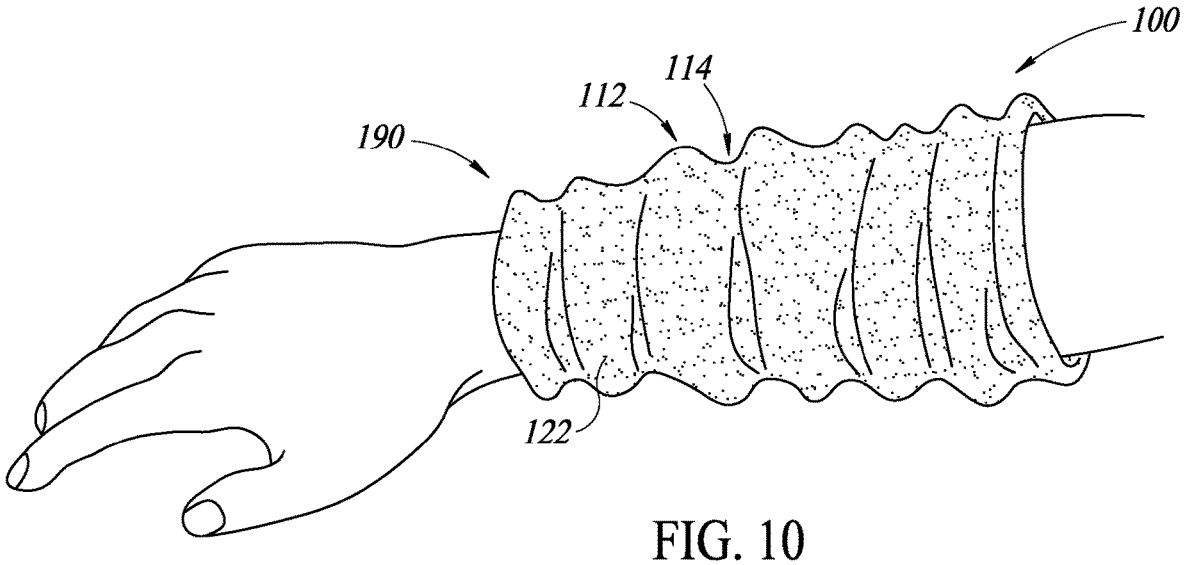
FIGS. 10 and 11 illustrate a germ absorbing member having undulations according to one or more embodiments of the present disclosure.
Figure 11:
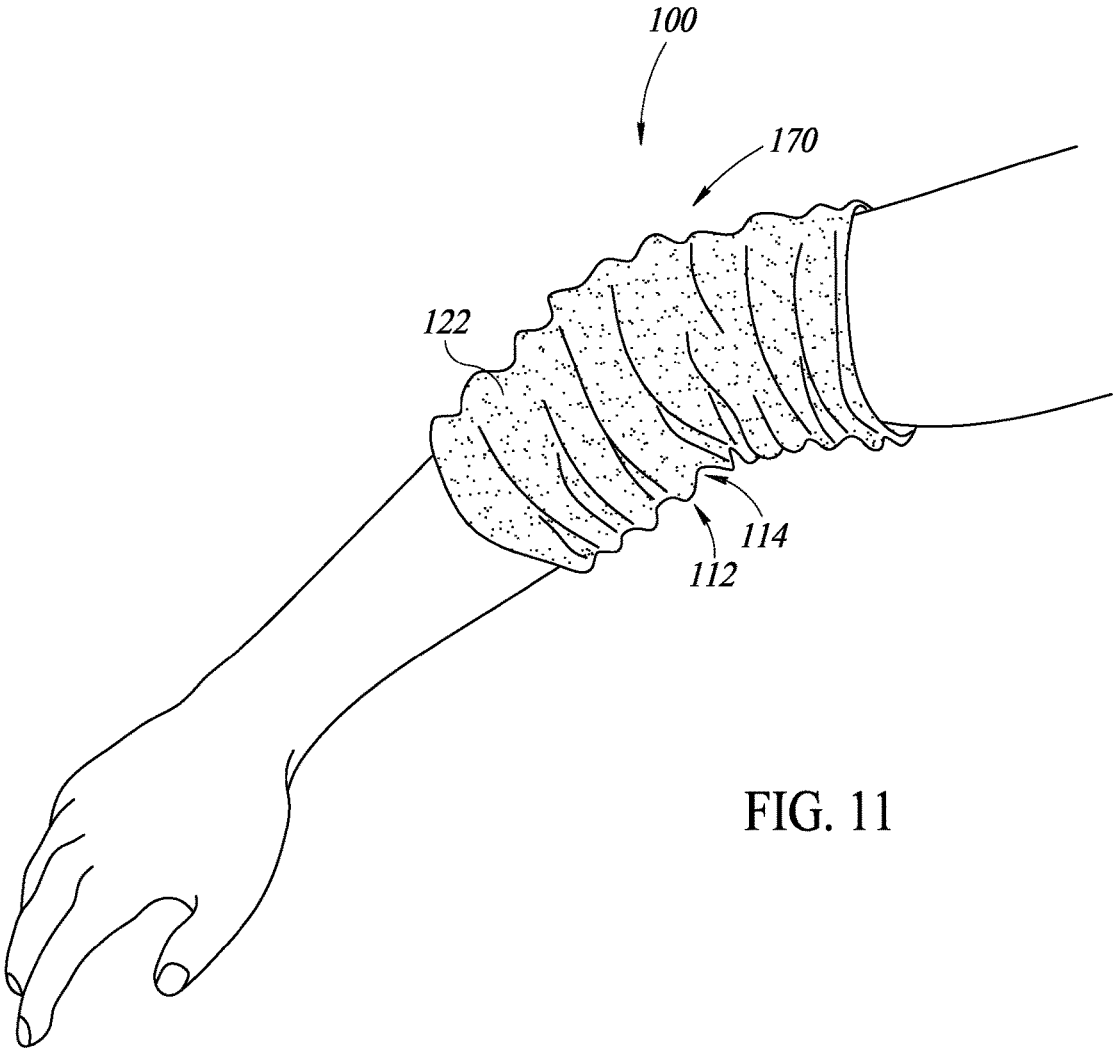

FIGS. 10 and 11 illustrate a germ absorbing member 100 having undulations according to one or more embodiments of the present disclosure.

FIGS. 10 and 11 show a germ absorbing member 100 having an exterior surface that has undulations. The germ absorbing member 100 which is implemented as a wearable corrugated-shaped cloth can slidably move from the wrist 190 of the user to all the way up to the shoulder or armpit of the user. In some embodiments, the corrugated-shaped cloth may be formed using a fiber that has elasticity and stretchability so that it may securely remain at a certain position upon the arm on which the user wishes to place the germ absorbing member 100.

The exterior surface of the germ absorbing member 100 has undulations consisting of a plurality of ridges 112 and a plurality of valleys 114. This is a cloth having a corrugated surface with a large exposed surface area. As described previously, a single sneeze can send about 100,000 germs into the air. In order to capture aerosol droplets from coughs and sneezes, the exterior surface of the germ absorbing member 100 has a plurality of ridges 112 and a plurality of valleys 114 to increase the surface area in which the airborne aerosol droplets can land on or be captured. The most critical time for spread of those germs is in the first moments after a cough or sneeze occurs and an increased surface area can ensure that the aerosol droplets including germs are captured and neutralized.

The cloth can be stretched out have lower ridges and less deep valleys or have the ends pushed towards each other provide higher ridges and deeper valleys while taking up less room on a person's arm. In one embodiment, the cloth can be worn having valleys and ridges that have double the surface area of straight cloth when not compressed at both ends. The same surface area is present on the cloth, but with the undulations the user can bunch both ends together and make the cloth have a short lineal distance on the arm. When the user is about to sneeze or cough, they can stretch the ends apart and thus provide a broad surface area to capture the sneeze. The cloth can be compressed again at both ends to old the captured germs and debris inside the folds of the cloth, pressed on the sidewalls between the ridges and the valleys. Any germs or debris that landed on the cloth are completely enclosed and captured. They have no further exposure to the air. Different parts of the cloth of FIGS. 10 and 11 can be used at different times and the cloth can be rotated on the arm to provide additional surface area to capture the debris from a sneeze or cough.

The increased surface area also assists in preventing the transmission of these aerosol droplets. The aerosol droplets often have a diameter less than the width of a human hair. The small size of the aerosol droplets adds the potential to penetrate deeper in the lungs. Moreover, the small size of the aerosol droplets causes the droplets to take significant time to eventually drop to the ground. That is, the droplets may remain suspended in the air for prolonged periods of time. Accordingly, having the user cough or sneeze into the germ absorbing member 100 having multiple undulations helps to capture the small sized aerosol droplets.

The germ absorbing member 100 has germicide particles 122 spread on the exterior surface. The germicide particles 122 include disinfectants that may eradicate or neutralize germs and pathogens. In addition, the germicide particles 122 include antiviral, antifungal, antimicrobial, antibacterial, and herbal materials to clean or sanitize the collected germs. The germicide particles 122 may further include any suitable germ absorbents or substances capable of neutralizing antigens. In one or more embodiments, the germicide particles 122 are non-toxic which will be safe for the user to use. Accordingly, a user coughing or sneezing into the germ absorbing member 100 containing the germicide particles 122 may have their orifices such as mouth and nose on the corrugated shaped cloth of the germ absorbing member 100.

The germ absorbing member 100 may be discarded after a predetermined number of uses or after a single use. Because once the germicide particles 122 absorbs and neutralizes the germs, the germicidal function of the germicide particles 122 is exhausted, there may be a limit for repeatedly cleaning and reusing the corrugated shaped cloth of the germ absorbing member 100.

Although not shown, the germ absorbing member 100 having a corrugated shaped cloth may have a moisture absorbing barrier 130 underneath so that the moisture and germs absorbed in the exterior surface does not permeate into and contact the skin or the clothes of the user. In these embodiments, the attachment member 140 may be omitted as the corrugated shaped cloth performs the attachment function.

FIGS. 12 to 15 illustrate various embodiment of the germ absorbing member 100 according to the present disclosure.

Figure 12:
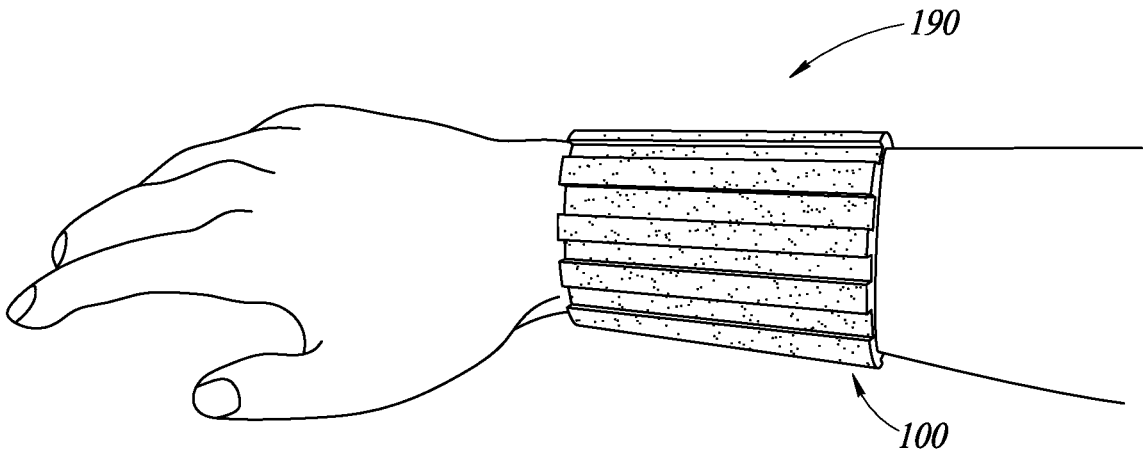
FIG. 12 illustrates a repeating step shaped germ absorbing member according to one embodiment of the present disclosure.
Figure 16A:
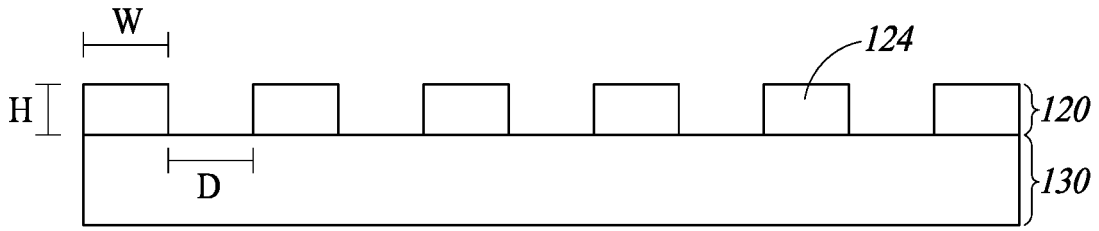
FIG. 16A illustrates a cross-section of a repeating step shaped germ absorbing member according to one embodiment of the present disclosure.

FIG. 12 illustrates a repeating step shaped germ absorbing member 100 according to one embodiment of the present disclosure. FIG. 16A illustrates a cross-section of a repeating step of a square shaped germ absorbing member 100 according to one embodiment of the present disclosure. In FIG. 12, the germ absorbing layer 120 has a repeating step shape that continues around the wrist 190. The germ absorbing layer 120 is as stretchable as a rubber band or an elastic band (e.g., having similar stretchability and fiber softness as tennis sweat wrist bands) and may be fixated to any part of the arm including forearms and armpits. The band may be sized to firmly and gently strap around any part of the arm.

The germicide particles 122 are spread out on the outer surfaces of the germ absorbing layer 120. In other embodiments, the germicide particles 122 are chemically or thermally treated so that the germicide particles 122 are included in the germ absorbing layer 120.

In some embodiments, the texture of the germ absorbing layer 120 is manufactured to have a sponge-like material. For example, the germ absorbing layer 120 may be a spongy, absorbing type of fabric.

Figure 13:
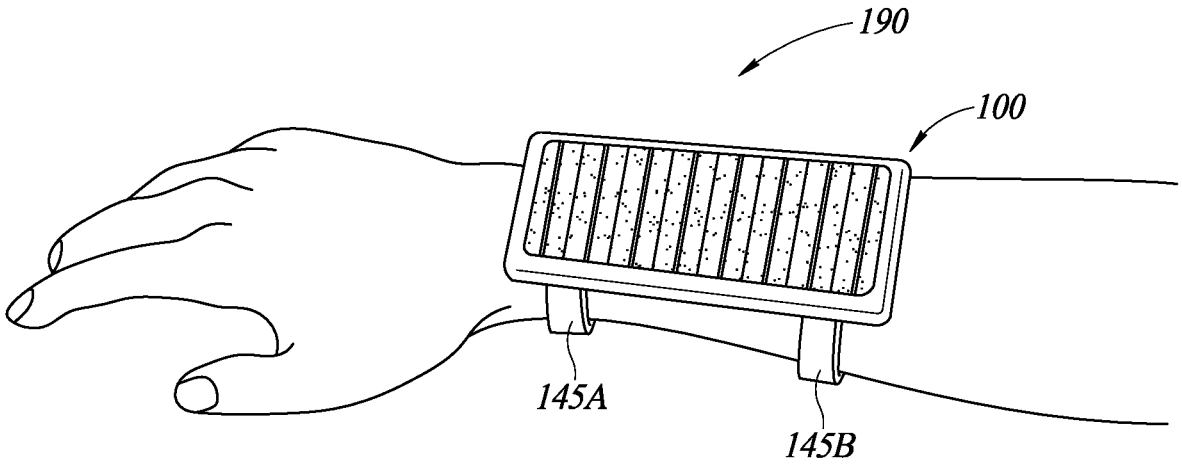
FIG. 13 illustrates repeating steps on one surface of a germ absorbing member according to one embodiment of the present disclosure.

FIG. 13 illustrates repeating square steps on one surface of a germ absorbing member 100 according to one embodiment of the present disclosure. Here, the germ absorbing layer 120 is placed on a moisture absorbing barrier 130 that has a rectangular shape. The attachment straps are coupled to the moisture absorbing barrier 130 so that the germ absorbing member 100 can be securely fixed to any part of the arm.

The cross-section of the germ absorbing layer 120 is similar to the cross-section of the germ absorbing layer 120 shown in FIG. 12 or FIG. 16A.

In other embodiments, the cross-section of the germ absorbing layer 120 may have a triangular shape instead of a square shape or a rectangular shape. As described previously, even though the cross-section may have a triangular shape, the material is formed with a soft fiber or a sponge-like fiber so a user may not be scratched or irritated by the contact with the germ absorbing layer 120.

Figure 14:
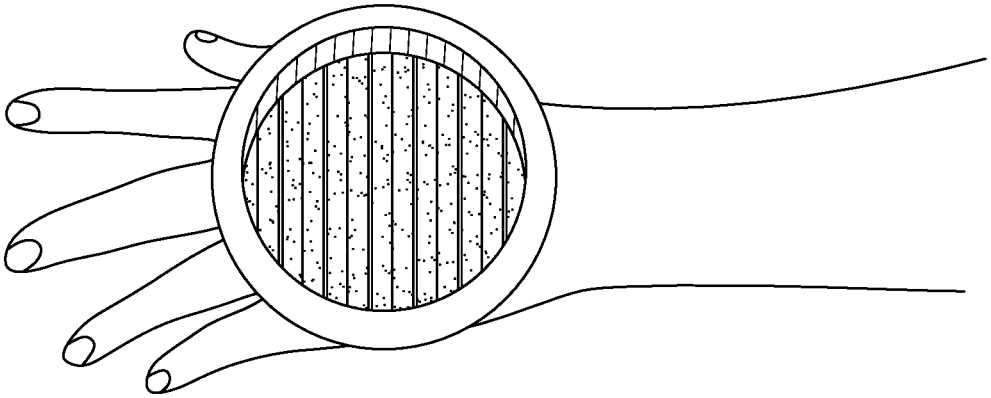
FIG. 14 illustrates a germ absorbing member having a cup shape that has interior surfaces having repeating square step shapes according to one embodiment of the present disclosure.

FIG. 14 illustrates a germ absorbing member 100 having a cup shape that has interior surfaces having repeating square step shapes according to one embodiment of the present disclosure. Here, the germ absorbing layer 120 is placed on the bottom surface of the cup. The bottom surface has repeating square step shapes to collect the germs when discharged by the user. The explanation of the arrangement of the moisture absorbing barrier 130 and the attachment member 140 have been omitted to avoid redundant description.

The side walls are adjacent to the bottom surface. The side walls are configured to prevent the escape of germs to the ambient air. To increase the surface area that the germs may contact, the bottom surface has a plurality of square tabs that projects upward toward the opening of the cup where the mouth or nose is meant to be placed.

Figure 15:
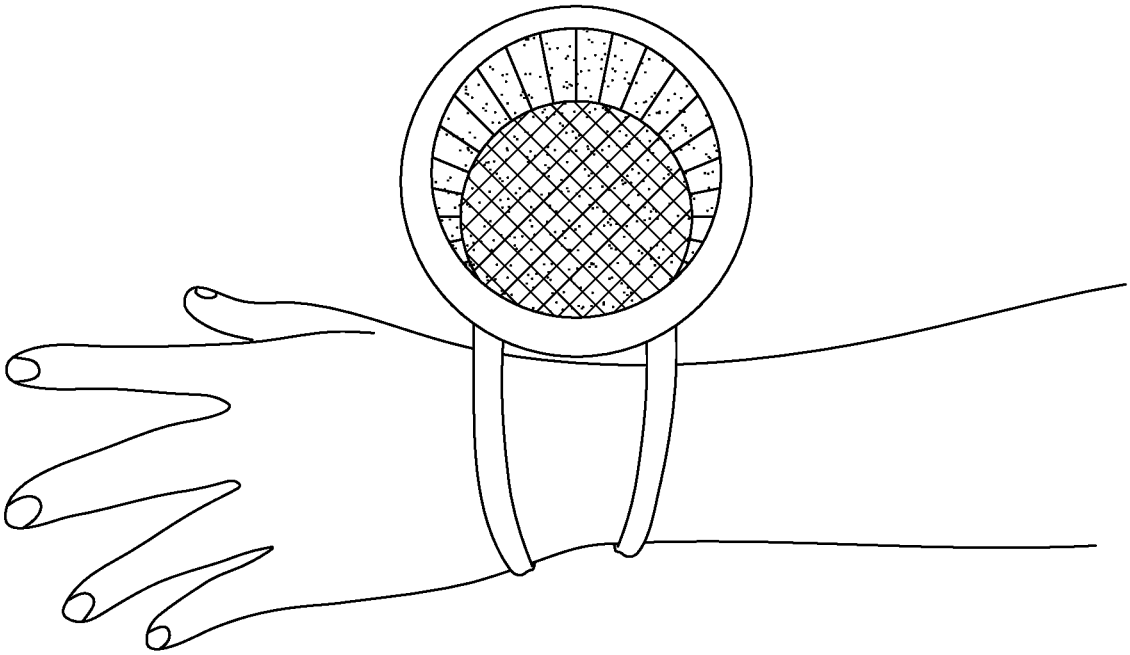
FIG. 15 illustrates a germ absorbing member having a cup shape that has interior surfaces having repeating square step shapes according to another embodiment of the present disclosure.

FIG. 15 illustrates a germ absorbing member 100 having a cup shape that has interior surfaces having repeating square step shapes according to another embodiment of the present disclosure. Here, the germ absorbing layer 120 is placed on the inner side surface of the cup. The inner side surface has repeating square step shapes to collect the germs when discharged by the user. In some embodiments, the bottom surface of the cup may also be covered by the germ absorbing layer 120 having certain patterns or shapes to increase the surface area. The attachment straps may be used to securely fix the cup shaped germ absorbing member 100 around the palm or to any part of the arm.

FIG. 16A illustrates a cross-section of a repeating step shaped germ absorbing member 100 according to one embodiment of the present disclosure. As shown in FIG. 16A, the germ absorbing layer 120 may be implemented using a plurality of repeating ridges 123 to increase the surface area in which the droplets discharged from the user's orifices can be captured. In FIG. 16A, each flexible square shaped fiber has a height H and a width W. The distance D between the immediately neighboring ridge 123 may be substantially identical to the width W. In some embodiments, the height H and the width W are the same, making the ridge 123 a square shaped ridge. In other embodiments, the height H and the width W are different. For example, the height H can be much greater than the width W so that the ridges would have a rectangular shape rather than a square shape. Further, in some embodiments, the distance D may be greater than the width W or less than the width W. Other various changes may be contemplated to increase the available areas for catching germs. When ridge is using having an H greater than a W, then substantially increased surface area for retaining moisture and germs is provided.

In one embodiment, the height H is between double and triple the width W and the distance D is between one-half and one-quarter the width W. This provides a very large surface area along the sidewall of the ridge 124 extending from the top of layer 130 to the top of the layer 120 for each ridge member. The sidewall of the ridge 124 in the layer 120 thus provides a large surface area that is more than double the surface area of that of the W and D combined. This large surface area on the sidewall of the ridge 124 provides an increased surface area to capture and retain germs. It can be used for a much longer time without being filled. It also will hide the debris from the cough or sneeze.

In one or more embodiments, to obtain a germ absorbing fiber or a germ capturing fiber as part of a germ absorbing layer 120, the germicide particles 122 may be chemically added onto the top surfaces and the side surfaces of the square shaped fiber. The areas spaced between the neighboring ridges 124 may also be treated with the germicide particles 122 so that the fiber can catch germs, viruses, bacteria, etc.

In can be readily appreciated that the surface area shown in FIG. 16A has significantly increased compared to the surface area shown in FIG. 2A or 2B which depicts a planar sheet or a pad. The significantly increased surface area increases the locations at which the moisture droplet can contact and be held by the surface of the flexible fibers.

Figure 16B:
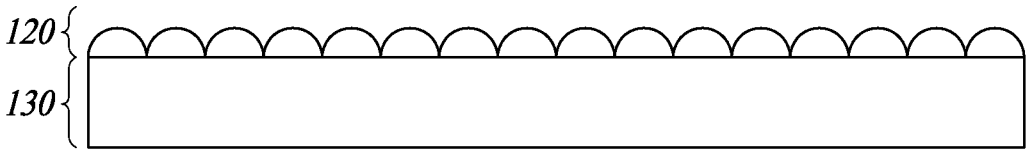
FIG. 16B illustrates a cross-section of a repeating half-circle shaped germ absorbing member according to one embodiment of the present disclosure.

FIG. 16B illustrates a cross-section of a repeating half-circle shaped germ absorbing member 100 according to one embodiment of the present disclosure. As shown in FIG. 16B, the germ absorbing layer 120 may be implemented using a plurality of half-circle or semi-circle shaped fibers to increase the surface area. These fibers may also be implemented as soft, sponge-like materials so that a user can put his or her orifices around the germ absorbing layer 120 and cough or sneeze into it. Although FIG. 16B shows the plurality of semi-circles are all substantially identical to each other across the germ absorbing layer 120, in some embodiments, the semi-circles may have different diameters. Further, in other embodiments, there may be spaces between neighboring semi-circles and the semi-circles do not necessarily have to be directly in contact with each other.

In one or more embodiments, to formulate a semi-circle shaped germ absorbing or germ capturing fiber as part of a germ absorbing layer 120, the germicide particles 122 may be chemically added onto the flexible fiber so that the germicide particles 122 can catch germs, viruses, bacteria, etc.

Figure 16C:
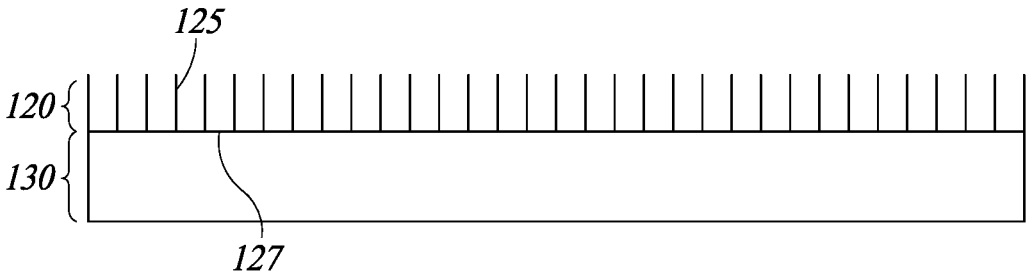
FIG. 16C illustrates a thin repeating thin thread germ absorbing member according to one embodiment of the present disclosure.

FIG. 16C illustrates a thin repeating rectangular shaped germ absorbing member 100 according to one embodiment of the present disclosure. As shown in FIG. 16C, the germ absorbing layer 120 may be implemented using a plurality of non-wavy shaped fibers to increase the surface area in which the droplets expelled by the user can be captured. However, the straight shaped fibers may nevertheless be flexible so that a user can put his or her nose or mouth around the germ absorbing layer 120. Although FIG. 16C shows the height of each flexible fiber being substantially identical to the fibers placed across the germ absorbing layer 120, in some embodiments, the individual height of the germ capturing fiber may have different heights. Although FIG. 16C shows the distance between two neighboring fibers as having substantially identical distances or intervals, in some embodiments, the distance between neighboring fibers may be various distances.

FIG. 16C shows the germ absorbing fibers or germ capturing fibers in the form of hundreds or thousands of individual filaments 125. A The individual filaments 125 can be round, square, rectangular, hexagonal, octagonal or other accepted shape In one or more embodiments, to formulate a germ absorbing fiber or a germ capturing fiber as part of a germ absorbing layer 120, the germicide particles 122 may be chemically added onto the flexible filament 125 so that the germicide particles 122 can more easily catch and retain germs. In can be readily appreciated that the surface area for capturing and retaining germs shown in FIGS. 16C and 16D has significantly increased compared to the surface area shown in FIG. 16A. The significantly increased surface area increases the probability of the moisture droplets contacting the surface of the flexible fibers in the form of filaments 125 and retaining them.

Figure 16D:
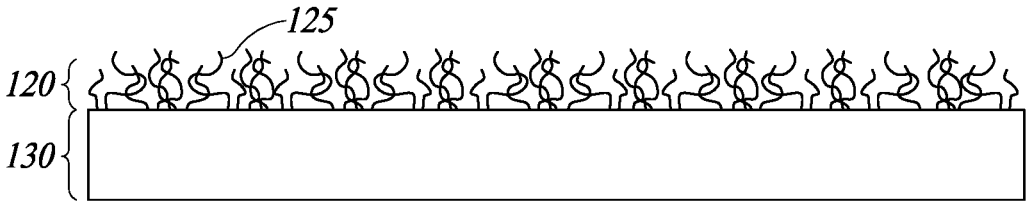
FIG. 16D illustrates a germ absorbing member having a wavy fiber shape according to one embodiment of the present disclosure.

FIG. 16D illustrates a germ absorbing member 100 having many wavy filaments 125 according to one embodiment of the present disclosure. As shown in FIG. 16D, the germ absorbing layer 120 may be implemented using a plurality of wavy filaments, flexible fibers, micro fibers in the form of filaments 125 or the like to increase the surface area in which the droplets expelled by the user can be captured.

That is, the germicide particles in the germ absorbing layer can capture the germs expelled into the air when a user coughs or sneezes into the germ absorbing member and eradicate the germs. Here, in order to enhance the probability of capturing most of the germs expelled, the germ absorbing layer includes various fibers in the form of filaments 125 with shapes and patterns. The flexible filaments are treated to have germicide particles in them. The various shapes, sizes, and patters of the flexible filaments create a large surface area that the germs can contact when they are expelled into air. The germ absorbing filaments may neutralize the germs and the used germ absorbing layer may be discarded. A new germ absorbing layer may be attached to the wearable member for repeated use.

To further elaborate the need of an increased surface contact area for germs, for example, one cough or sneeze can discharge an average about 50,000 droplets. Each droplet may have about 20 bacteria in it which sums up to about 100,000 contagious bacteria or germs on one cough or sneeze. Accordingly, having a plurality of wavy fibers on the surface of the germ absorbing member 100 can ward off catching germs, viruses, bacteria, etc. To elaborate, for viruses like colds and flus, at least about 1,000 contagious bacteria or germs is required to cause infection.

To substantially mitigate this, in some embodiments of the present disclosure, the wavy filaments 125 may be implemented using materials having hydrophilic properties. This may significantly increase the probability of the moisture droplets sticking to the wavy filament. In further embodiments, both employing materials having hydrophilic properties and increasing the contact surface area may be utilized to maximize the capture rate of the droplets.

In the design of FIGS. 16C and 16D, the length, shape and placement of the individual filaments 125 is selected to provide a large surface area along the length of the filament to capture and hold the germs. In a preferred embodiment the diameter of each filament 125 is in the range of 0.04 to 0.5 millimeters (mm) with a preferred diameter in the range of 0.08 to 0.3 mm.

The preferred diameter will be different depending on the properties of the filament 125. If the primary property of the filament is to capture and hold germs on the outer diameter, then having many filaments that are in the smaller diameter range is preferred to provide an overall larger surface area of the combined filaments 125 as a whole on the layer 130. This would tend towards having filaments in the range of 0.05 to 0.1 mm. Since the diameter is smaller, there would be more filaments in a given area on the layer 130. For some types of hydrophilic filaments, their operation might be to draw moisture into the core of the filament and hold the moisture on the inside. For this type of filament, a larger internal area is preferred since moisture is being held on the inside. Thus, for particular hydrophilic filaments, an average diameter in the range of 0.5 to 1.5 mm is preferred. There will be fewer filaments in a given surface area, but a larger internal area of the layer 120 is provided in the layer 130 as a whole.

For example, the filament 125 can be a synthetic fiber produced by incorporating a water absorption resin having a water absorption ratio in a range from 500 to 4000% by weight into an elastic fiber such as a polyurethane fiber or a polyurethane-urea fiber in a finely dispersed state in an amount in a range from 1 to 15% by weight relative to a fiber-forming polymer.

The length of each filament 125 is in the range of 5 mm to 10 mm, with a preferred length of 5 to 7 mm. The length is therefore about 10 to 12 times greater than the diameter and is some embodiments the length will be in the range of 25 to 50 times greater than the diameter. The spacing between the filaments 125 is also selected to provide a high capture rate of the germs. If the filaments are overly dense, the drops carrying the germs cannot get into the body of the filaments since the tops will be close to each other, which would defeat the goal of capturing the germs and debris on the sidewalls and interior of the filaments. If they are too sparse, there will not be as many filaments as could be used to capture a large quantity of germs. Given these parameters, testing of the particular filament selected for each application can be carried by those skilled in the art to select a desired diameter, spacing and density. It is expect that it will be different for the different types of filaments. For example, a cotton fiber filament will have different spacing and properties than a synthetic one made of rayon, which will be different again from one made of polyester or a polyurethane with resin inside.

In a preferred embodiment, the open space 127 between the filaments 125 at the base where they attach to the layer 130 will always be greater than the diameter of the filament itself and in another preferred embodiment, the space 127 is between 1.5 and 4 times the diameter of each individual filament at their base. The space 127 might be as great as 10 times their diameter in other embodiments. Of course, for the wavy filaments 125, the ends might entangle and they might become very close or cross each other along their lengths, which is permitted and in some designs desirable to catch and retain more germs and debris. The spacing 127 is measured at the base, where the filaments 125 attach to the layer 130. As can be seen in 16D, the distances do not need to be uniform. They can be uniform as shown in 16C and all be the same space 127. Alternatively, the space 127 between them can vary from a small distance of one diameter apart to as much as 10 diameters apart, all in the same structure. This permits high density filaments 125 to be provided, but with sufficient spacing that germs and debris can enter between the filaments 125 and be captured.

A person of ordinary skill in the art will readily appreciate that based on the embodiments described in FIGS. 16A to 16D, further various combinations of these embodiments may also be contemplated. For example, the wavy flexible filaments 125 shown in FIG. 16D may be added on top of the triangular shaped fibers or may be added on top of the square shaped fibers described in FIG. 16A.

Figure 17A:
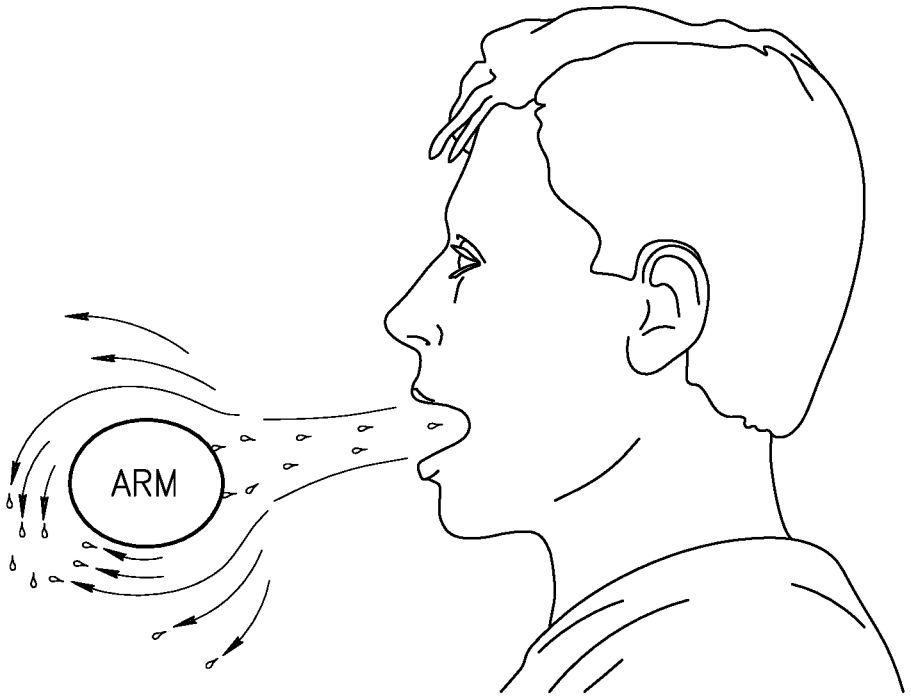
FIG. 17A illustrates the pathway of aerosol droplets when a user coughs or sneezes into the user's arm according to the prior art.
Figure 17B:
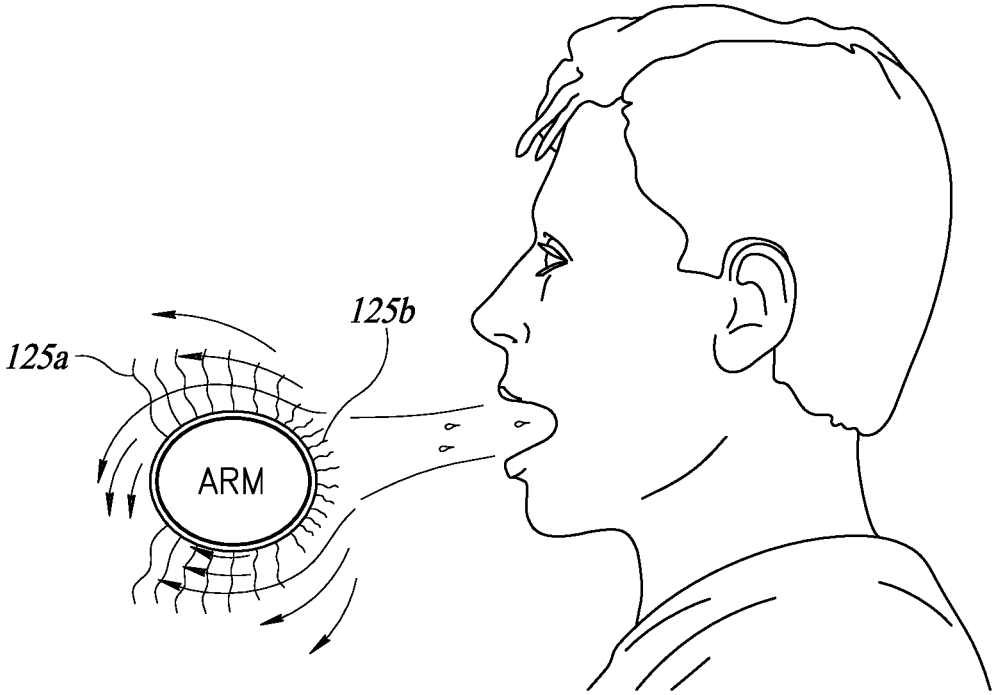
FIG. 17B illustrates a germ absorbing fiber in a germ absorbing layer having different sizes, shapes, and patterns to capture aerosol droplets moving in various pathways when a user coughs or sneezes into the user's arm.

FIG. 17A illustrates the pathway of aerosol droplets when a user coughs or sneezes into the user's arm according to the current art, without using the present invention. To elaborate, the aerosol droplets are expelled from the mouth or the nose up to about 100 miles per hour. As shown in FIG. 17A, when a user coughs or sneezes into the armpit or the elbow or elsewhere upon the arm, there is a space where the discharged aerosol droplets can escape. Namely, the aerosol droplets can escape to the space that is over or under the arm. While a majority of the aerosol droplets may land on the arm when the user coughs or sneezes directly into the arm, as described above, one cough or sneeze can discharge an average about 50,000 droplets. Assuming that roughly about 50% of the droplets are likely to land on the arm (because the user exactly aimed towards the arm), the rest of the 50% may travel at a high speed elsewhere (e.g., over and under the space of the arm). Accordingly, the length of the filaments shown as in FIG. 16C or 16D can have different lengths at different positions to capture the escaping droplets. FIG. 17B illustrates a germ absorbing fiber in a germ absorbing layer having different sizes, shapes, and patterns to capture aerosol droplets moving in various pathways when a user coughs or sneezes into the user's arm. As shown, for example, the length of the filaments 125*a* in the peripheral space of the arm facing away from the user where the droplets are likely to escape may be longer than the filaments 125*b* that are close to the mouth. The region where the user directly coughs or sneezes into may have a relatively shorter filament length as the aerosol droplets may be easier to catch even with relatively shorter germ absorbing fibers.

The distance between each filaments 125 shown in 17B is not to scale and they will usually be more dense with the shorter filaments 125*b* being more densely packed, namely closer to each other than the longer filaments 125*a*.

The longer filaments 125*a* might be about 2 to 3 times longer than the shorter filaments 125*b*. They may have a space between them that is about 1.5 to 2.5 times greater than the space between the shorter filaments. The spacing between them can gradually increase as the length of the filaments 125*a* is increasingly longer, the further from the face.

Figure 17C:
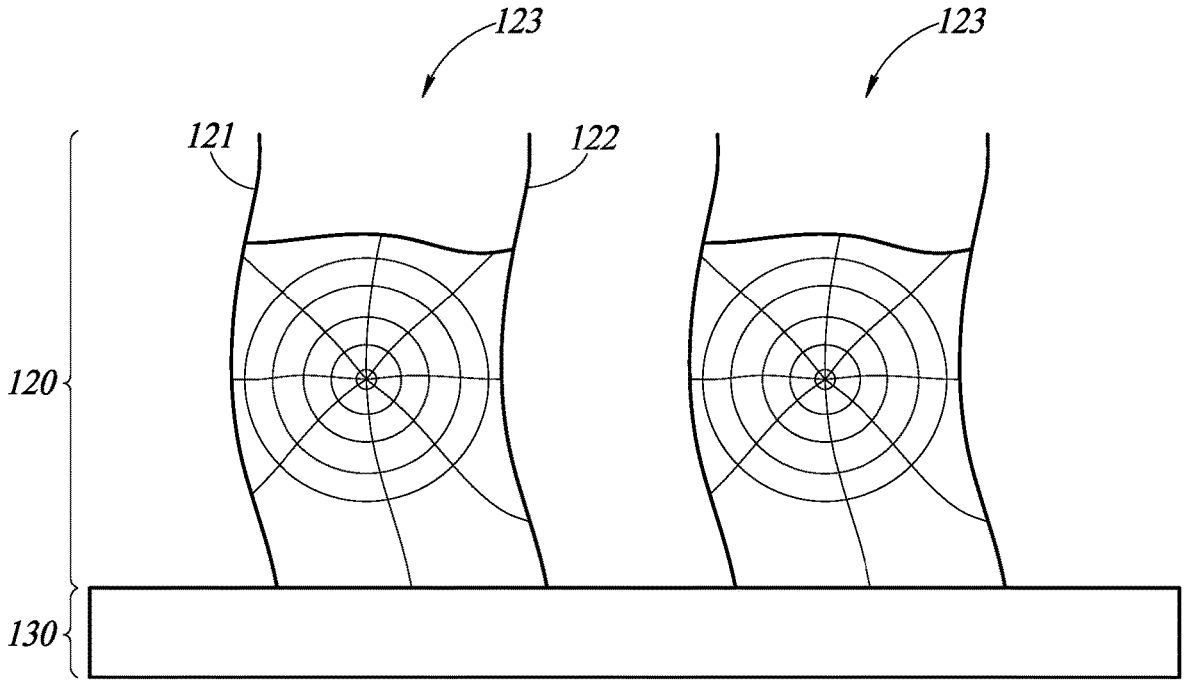
FIG. 17C illustrates another embodiment of a germ absorbing fiber in the germ absorbing layer according to the present disclosure.

FIG. 17C illustrates another embodiment of a germ absorbing fiber in the germ absorbing layer according to the present disclosure. As shown, an additional spider-web shape fiber 123 is formed between a first germ absorbing fiber 121 and a second germ absorbing fiber 122 which is neighboring the first germ absorbing fiber 121. In some embodiments, the length of the first germ absorbing fiber 121 and the length of the second germ absorbing fiber 122 may defer from each other. As explained in connection with embodiments of FIG. 17B, in certain part of the germ absorbing layer 120, the germ absorbing fibers may have different lengths in order effectively capture the fast moving aerosol droplets. Further, fibers having spider-web shapes 123 or other shapes suitable for effectively catching the droplets may be utilized.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An apparatus comprising:

a band assembly having a flexible layer that is formable in circular configuration, the band assembly configured to be wrapped around hand of a user of a user;

a moisture absorbing assembly connected to the band assembly and configured to be positioned on the back of the hand of the user, the moisture absorbing assembly including:

a moisture proof barrier coupled to the moisture absorbing assembly; and a flexible, moisture absorbing member having a first side and a second side opposite of the first side, the flexible, moisture absorbing member contacting the moisture proof barrier at the first side and the second side of the flexible, moisture absorbing member directly adjacent to ambient air, wherein the second side of the flexible, moisture absorbing member has an undulating surface that includes ridges and valleys, wherein the flexible, moisture absorbing member includes a plurality of fibers that is comprised of a fibrous material having fibers that retain moistures that contact them, the plurality of fibers being spaced apart from each other, wherein the plurality of fibers have a first fiber set and a second fiber set having fibers spaced apart from the first fiber set, and wherein the first fiber set is positioned on the ridges of the second side of the flexible, moisture absorbing member, and the second fiber set is positioned in the valleys of the second side of the flexible, moisture absorbing member.

2. The apparatus of claim 1, wherein the first fiber set of the plurality of fibers have a first fiber length and the second fiber set of the plurality of fibers have a second fiber length that is longer than the first fiber length.

3. The apparatus of claim 1, wherein the ridges have a top surface and the valleys have sidewalls and a bottom surface, the first fiber set being arranged on the top surface of the ridges and the second fiber set being arranged on the sidewalls and the bottom surface of the valleys.

4. The apparatus of claim 1, wherein the first fiber set is positioned in the ridges directly faces an orifice of the user in a location that any moisture from the orifice of the user will reach the first fiber set before reaching the second fiber set, and the second fiber set is positioned in the valleys at a location that is farther from an orifice of the user than the first fiber set.

5. The apparatus of claim 1, wherein the second fiber set positioned in the valleys at a location that is farther from an orifice of the user than the first fiber set has a longer fiber length than the first fiber set to capture the moisture that is not captured by the first fiber set.

6. The apparatus of claim 1, wherein the flexible, moisture absorbing member has a bar shape that extends parallel to an arm of the user.

7. The apparatus of claim 1, wherein the flexible, moisture absorbing member has a cylindrical shape that extends transverse to a length direction of an arm of the user.

8. The apparatus of claim 7, wherein the cylindrical shape includes a sidewall and a base surface, wherein the base surface forms the second side of the flexible, moisture absorbing member.

9. The apparatus of claim 8, wherein the sidewall have thereon a third fiber set that is comprised of a fibrous material having fibers that retain moisture that contact them.

10. The apparatus of claim 9, wherein the first fiber set, the second fiber set, and the third fiber set includes transparent fibers.

11. The apparatus of claim 1, wherein the moisture proof barrier is configured to be in direct contact with either a cloth the user is wearing or a skin of the user.

12. The apparatus of claim 1, wherein the flexible, moisture absorbing member is formed as a disposable material that is both attachable and detachable from the moisture proof barrier.

13. An apparatus comprising:

an arm band assembly having a flexible layer that is formable in circular configuration, the arm band assembly configured to be wrapped around a forearm of a user, adjacent to the wrist;

a moisture absorbing assembly connected to the band assembly and configured to be positioned on the forearm of the user, the moisture absorbing assembly including:

a moisture proof barrier coupled to the arm band assembly; and a flexible, moisture absorbing member having a first side and a second side opposite of the first side, the flexible, moisture absorbing member contacting the moisture proof barrier at the first side, the second side of the flexible, moisture absorbing member directly adjacent to ambient air, wherein the second side of the flexible, moisture absorbing member has a square-wave like shape including ridges and valleys, wherein the flexible, moisture absorbing member includes a plurality of fibers that is comprised of a fibrous material having fibers that retain moistures that contact them, the plurality of fibers being spaced apart from each other, wherein the plurality of fibers have a first fiber set and a second fiber set having fibers spaced apart from the first fiber set, and wherein the first fiber set is positioned in the ridges of the second side of the flexible, moisture absorbing member, and the second fiber set is positioned in the valleys of the second side of the flexible, moisture absorbing member.

14. The apparatus of claim 13, wherein the ridges have a top surface and the valleys have sidewalls and a bottom surface, the first fiber set being arranged on the top surface of the ridges and the second fiber set being arranged on the sidewalls and the bottom surface of the valleys.

15. A method comprising:

attaching a germ absorbing member to an arm of a user, the germ absorbing member including attachment straps for attaching to the arm of the user, a moisture absorbing barrier that is adjacent to the arm of the user, and a germ absorbing layer that is positioned between an ambient air and the moisture absorbing barrier, wherein the germ absorbing layer has a first side including a square-like wave shape and a second side, the first side having valleys and ridges that contacts the ambient air and the second side opposite of the first side contacting the moisture absorbing barrier;

receiving droplets of moisture discharged from orifices of the user into the germ absorbing layer, wherein the germ absorbing layer includes a plurality of fibers that is comprised of a fibrous material having fibers that retain moistures that contact them, the plurality of fibers being spaced apart from each other, and the plurality of fibers have a first fiber set and a second fiber set having fibers spaced apart from the first fiber set, wherein the first fiber set is arranged in the ridges and the second set is arranged in the valleys, the receiving droplets of moisture including:

capturing a first set of droplets of moisture with a first fiber set having a first fiber length;

capturing a second set of droplets of moisture with a second fiber set having a second fiber length that is longer than the first fiber length;

removing the germ absorbing layer from the arm of the user; and discarding the germ absorbing layer, wherein the first fiber set is positioned in a top surface of the ridges of the germ absorbing layer that is facing an orifice of the user in a location that any moisture from the orifice of the user will reach the first fiber set before reaching the second fiber set, and the second fiber set is positioned in a bottom surface and side surfaces of the valleys of the germ absorbing layer at a location that is farther from the orifice of the user than the first fiber set.

16. The method of claim 15, wherein the germ absorbing layer is configured to eradicate any disease-causing substances included in the droplets of moisture, the germ absorbing layer including germicides.

17. The method of claim 15, wherein the germ absorbing member has a cylindrical shape that extends transverse to a length direction of an arm of the user.

18. The method of claim 15, wherein the germ absorbing member has a bar shape that extends parallel to an arm of the user.

19. The method of claim 15, wherein the attachment straps are formed in a bracelet shape configured to be wrapped around a wrist of the user, the attachment straps formed with at least one of metal or plastic.

20. The method of claim 15, wherein the germ absorbing layer is formed with materials that can be either attachable or detachable from a surface of a skin of the user.

* * * * *